US005958114A

United States Patent [19]

Sunahara et al.

[11] Patent Number: 5,958,114

[45] Date of Patent: Sep. 28, 1999

[54] INDOOR UNIT OF AIR-CONDITIONER

[75] Inventors: Hiroshi Sunahara, Fujinomiya; Yasunori Ichikawa; Kenji Gajina, both of Fuji; Katsuaki Yamagishi, Yokohama; Yukio Kiguchi, Fuji; Masahiko Sasaki, Fuji; Hiroyuki Sugiyama, Fuji; Daisuke Saito; Teturo Ozawa, both of Numazu, all of Japan

[73] Assignee: Kabushiki Kaisha Toshiba, Kawasaki, Japan

[21] Appl. No.: 08/949,329

[22] Filed: Oct. 3, 1997

[30] Foreign Application Priority Data

| | | | |
|---|---|---|---|
| Oct. 3, 1996 | [JP] | Japan | 8-263087 |
| Nov. 20, 1996 | [JP] | Japan | 8-309591 |
| Feb. 19, 1997 | [JP] | Japan | 9-035029 |

[51] Int. Cl.[6] ..... B01D 46/00

[52] U.S. Cl. ..... 96/417; 55/385.2; 55/467.1; 55/471; 55/480; 55/481; 55/DIG. 6; 55/DIG. 34

[58] Field of Search ..... 95/11, 25, 273, 95/286, 288; 96/399, 400, 417; 55/385.1, 385.2, DIG. 6, 478, 480, 481, 467, 471, 473, 490.1, 490.2, 467.1, DIG. 34

[56] References Cited

U.S. PATENT DOCUMENTS

| | | | |
|---|---|---|---|
| 1,838,505 | 12/1931 | Shurtleff | 55/471 |
| 2,021,437 | 11/1935 | Walsh | 55/471 |
| 2,044,832 | 6/1936 | Child | 55/467.1 |
| 3,357,763 | 12/1967 | Toper | 55/467.1 |
| 3,412,530 | 11/1968 | Cardiff | 55/481 |
| 4,191,543 | 3/1980 | Peters | 55/385.1 |
| 4,560,395 | 12/1985 | Davis | 55/385.2 |
| 4,662,912 | 5/1987 | Perkins | 55/467 |
| 4,713,099 | 12/1987 | Schroeder | 55/385.1 |
| 4,724,749 | 2/1988 | Hedrick | 55/DIG. 6 |
| 5,094,676 | 3/1992 | Karbacher | 55/385.1 |
| 5,348,563 | 9/1994 | Davis | 55/385.2 |
| 5,679,121 | 10/1997 | Kim | 55/DIG. 6 |

FOREIGN PATENT DOCUMENTS

| | | | |
|---|---|---|---|
| 2-251215 | 10/1990 | Japan | 55/471 |
| 5-40726 | 6/1993 | Japan . | |
| 6-159718 | 6/1994 | Japan . | |

*Primary Examiner*—Duane S. Smith
*Attorney, Agent, or Firm*—Pillsbury Madison & Sutro LLP

[57] ABSTRACT

An indoor unit of an air-conditioner having a unit body, provided on a rear of a ceiling, having an lower surface portion exposed indoor and an indoor heat exchanger and a blower in its exterior, a decorative panel, structured as the lower surface portion for the unit body, having an inlet port for guiding air in a room to the indoor heat exchanger, a filter fixing portion, structured as a part of the decorative panel, having a filter attached to a position opposite to the inlet port to be detachable, a support portion for supporting the filter fixing portion to be freely rotatable to the decorative panel, and an open/close driving mechanism for driving the filter fixing portion to be freely opened and closed against the decorative panel in a state that the support portion is used as a fulcrum, the mechanism for hanging the filter fixing portion from a ceiling surface when being opened to be moved.

21 Claims, 22 Drawing Sheets

INDOOR UNIT OF AIR-CONDITIONER

BACKGROUND OF THE INVENTION

The present invention relates to an indoor unit of an air-conditioner placed on the rear of a ceiling, and particularly to improvement of a filter attaching structure.

There is a tendency that the indoor unit of the air-conditioner placed on the rear of the ceiling is often used. By use of this type of units, a necessary air-conditioning function can be obtained without having an oppressive feeling and spoiling the appearance.

However, in such an air-conditioner, a filter, which is provided to an inlet port, captures more than a predetermined amount of dust when it is driven for a long period of time. As a result, the filter is clogged with dust, and ventilation resistance is increased, and heat exchange ability is reduced.

After the filter is used for a predetermined period of time, a user cleans the filter or replaces the filter with a new filter.

However, since a unit body is attached to a ceiling surface, and the user cannot reach for the filter. Due to this, the user uses a stepladder to detach the filter fixing portion, and the detached filter is once put on a location such as a floor where the user can easily replace the filter with new one.

Then, the user removes the captured dust or replaces the filter with new one, and lifts up the filter fixing portion to be inserted to a decorative panel. Thus, it takes a large amount of time for the user to replace the filter with new one, and the replacement of the filter at the high location brings about danger.

BRIEF SUMMARY OF THE INVENTION

An object of the present invention is to provide an indoor unit of an air-conditioner, which can easily replace a filter with new one to obtain safety, and which can maintain a heat exchanger to have high heat exchanging ability.

According to the present invention, there is provided an indoor unit of an air-conditioner comprising: a unit body, provided on a rear of a ceiling, having an lower surface portion exposed indoor and an indoor heat exchanger and a blower in its exterior; a decorative panel, structured as the lower surface portion for the unit body, having an inlet port for guiding air in a room to the indoor heat exchanger; a filter fixing portion, structured as a part of the decorative panel, having a filter attached to a position opposite to the inlet port to be detachable; a support portion for supporting the filter fixing portion to be freely rotatable to the decorative panel; and an open/close driving mechanism for driving the filter fixing portion to be freely opened and closed against the decorative panel in a state that the support portion is used as a fulcrum, the mechanism for hanging the filter fixing portion from a ceiling surface when being opened to be moved.

Additional objects and advantages of the invention will be set forth in the description which follows, and in part will be obvious from the description, or may be learned by practice of the invention. The objects and advantages of the invention may be realized and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments give below, serve to explain the principles of the invention.

DETAILED DESCRIPTION OF THE INVENTION

Figure 1:
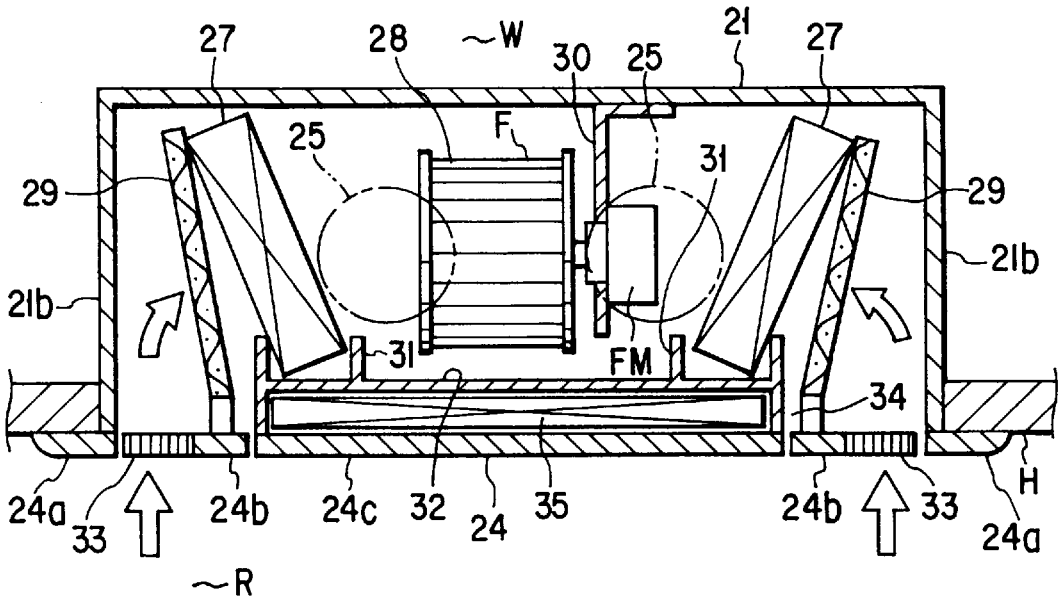
FIG. 1 is a cross-sectional view showing an indoor unit of an air-conditioner according to a first embodiment of the present invention.

An embodiment of the present invention will now be described with reference to the accompanying drawings.

First, a first embodiment will be described as follows:

FIGS. 1 to 3 and 5 show an indoor unit of an air-conditioner.

A unit body 21 is rectangularly box-shaped and only the lower end portion of the unit body 21 is opened. A fitting member 22 is provided on an outer peripheral side of a side surface portion 21*a* along a lateral direction of the unit body 21. The fitting member 22 is supported by a hanging bolt 23, which is perpendicularly formed from the rear of the ceiling of a house (not shown).

The lower surface opening portion of the unit body 21 is closed by a decorative panel 24. The decorative panel 24 is exposed to an air-conditioning room R from a ceiling H. However, excepting the decorative panel 24, the unit body 21 is attached to be projected to a ceiling rear W from the ceiling H.

A plurality of blow-off ports 25 are opened on both side portions 21*b* of the unit body 21. Blow-off ducts 26 are connected to these blow-off ports 25, and the blow off ducts 26 are extended to blow-off portions (not shown) formed on the ceiling of the room R. Or, if blow-off portions are also provided on the ceiling of another air-conditioning room, the blow-off ducts 26 are extended thereto.

Two pairs of an indoor heat exchanger 27 and a centrifugal blower 28 are arranged in the unit body 21. Each indoor heat exchanger 27 is placed at a position close to the side surface portion 21 in the longitudinal direction and along the longitudinal direction of the unit body 21.

Each indoor heat exchanger 27 is formed such that its upper end portion is inclined to the outside and its lower end portion is inclined to the inside. Particularly, as shown in FIG. 1, both indoor heat exchangers 27 are symmetrically inclined, seeing from the side surface of the unit body 21.

Each centrifugal blower 28 is provided between the indoor heat exchangers 27, and its axial direction is along the lateral direction of the unit body 21, which is the direction perpendicular to the longitudinal direction of the indoor heat exchanger 27.

Each centrifugal blower 28 comprises a fan motor FM, which is fixed to the unit body 21 by a support 30, and a scirocco fan F, which is attached to a rotation shaft of the fan motor FM. The positions of the fan motor and the fan are reversed, seeing from the plane.

Each scirocco fan F has a characteristic in which air is blasted from an axial direction and blown off in a circumferential direction. The indoor heat exchanger 27 is positioned to be opposite to the blasting direction of the scirocco fan F. The blow-off air is guided to the blow-off port 25 formed on the side surface portion 21*b* by a fan casing 28*a*.

A filter 29 is provided between each indoor heat exchanger 27 and the surface portion 21*b*. These filers 29 are inclined to be substantially parallel to the indoor heat exchangers 27, and these filters 29 are attached to the decorative panel 24 to be detachable through attaching means (not shown).

A drain pan 31 is provided on the lower end portion of each indoor heat exchanger 27 so as to receive drain water, which is generated by condensing water in the air. A substrate 32 is formed as one body with these drain pans 31.

On the other hand, a pair of inlet ports 33 is opened on the decorative panel 24, and a grill is inserted thereto. These inlet ports 33 are rectangularly shaped along the side surface portion 21*b* in the longitudinal direction of the unit body 21. Since the decorative panel 24 is exposed indoor, the inlet ports 33 are opened to the room R.

As shown in only FIG. 1, a spatial portion 34 is formed among the drain pan 31, the substrate 32, and the decorative panel 24, and an open/close drive mechanism 35 (to be described later) for driving the decorative panel 24 to be freely opened and closed is provided in the spatial portion 34.

Figure 3:
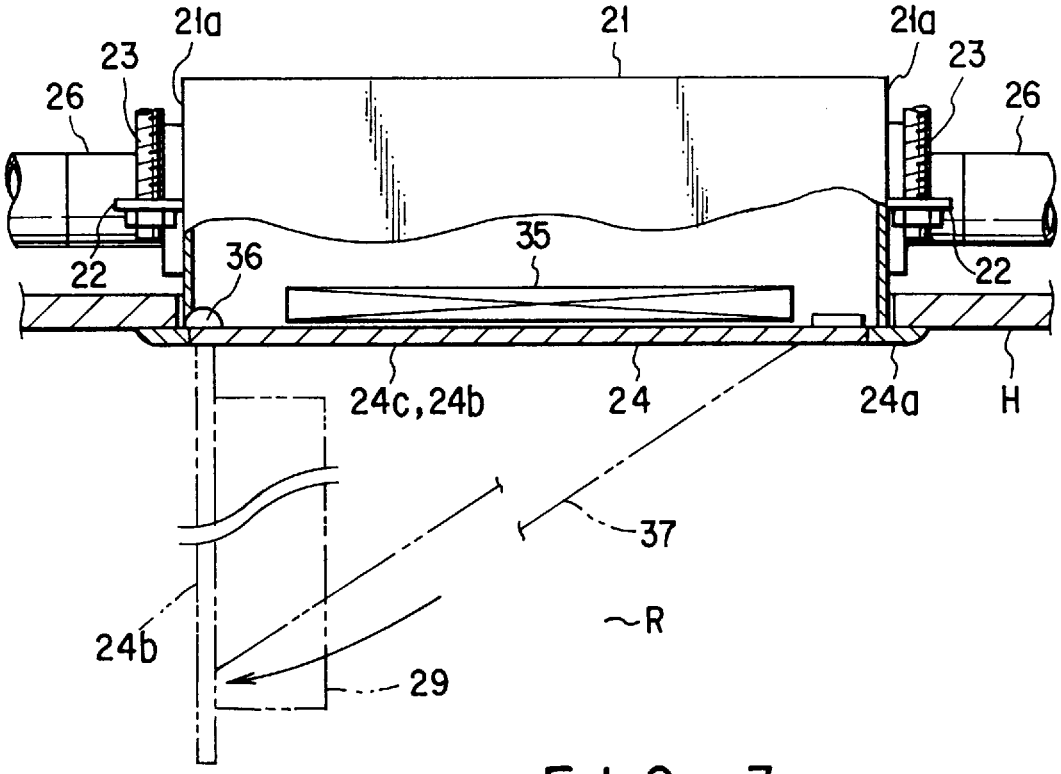
FIG. 3 is a side view showing the indoor unit.
Figure 5:
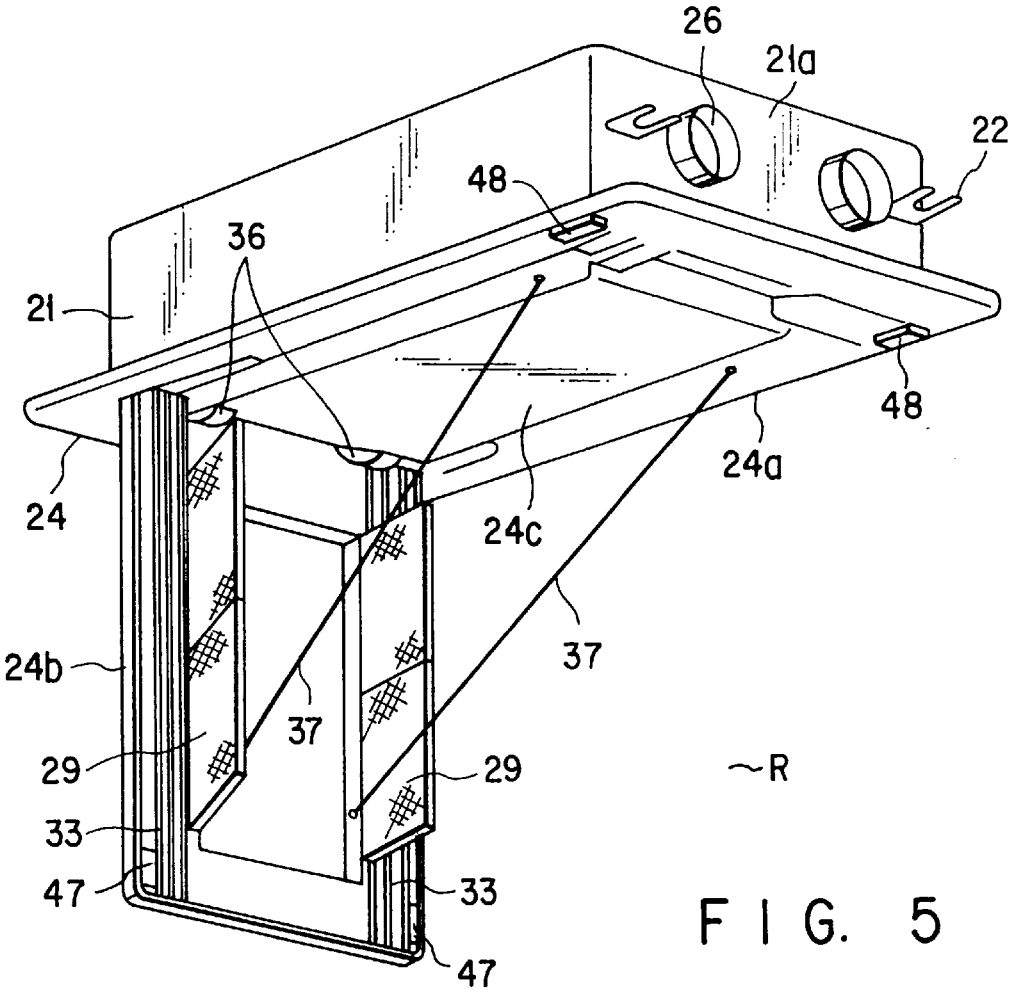
FIG. 5 is a perspective view showing the indoor unit in a state a filter fixing portion is opened.

As shown in FIGS. 3 and 5, the decorative panel 24 comprises a circumferential frame portion 24*a*, a filter fixing portion 24*b*, and a central panel portion 24*c*. The filter fixing portion 24*b* is surrounded with the circumferential frame portion 24*a*, and has the inlet ports 33. The filters 29 are fixed to the filter fixing portion 24*b*. The central panel portion 24*c* is surrounded with the filter fixing portion 24*b*, and contains the open/close drive mechanism 35.

A support portion 36 is provided on one side end of the longitudinal direction of the filter fixing portion 24*b*. The support portion 36 supports the filter fixing portion 24*b* to be rotatable to the circumferential frame portion 24*a*. On end portion of each wire 37, serving as an actuation cord, is connected to both ends of the other side end, which is opposite to the support portion 36. The other end of each wire 37 is extended to the open/close drive mechanism 35, which is positioned in the spatial portion 34 of the central panel portion 24*c*.

Figure 4:
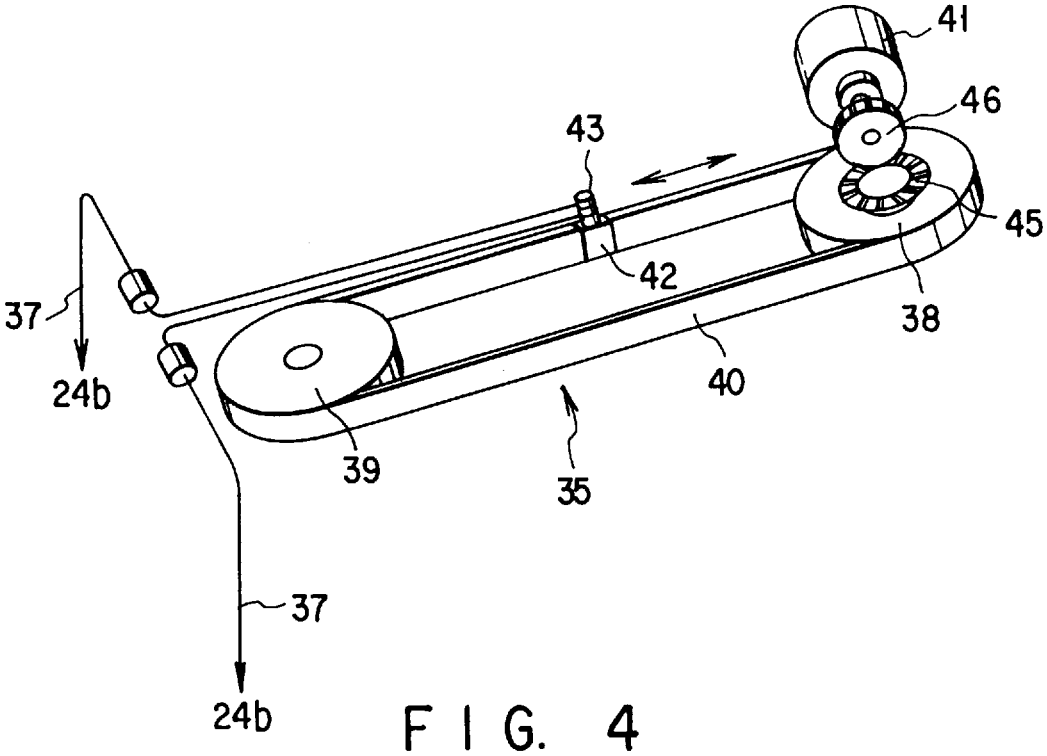
FIG. 4 is a perspective view showing an open/close drive mechanism.

As shown in FIG. 4, the open/close drive mechanism 35 comprises a pulley 38 for a drive side, a pulley 39 for a follower side, a belt 40, which is stretched between these pulleys 38 and 39 to be endlessly run, a drive source 41 for driving the pulley 38 to be rotated, and the support portion 36, and the wires 37.

A fixing member 42 having a pin projected is provided at a predetermined portion of the belt 40. The other end of each wire 37 is fixed to the pin 43.

Figure 6:
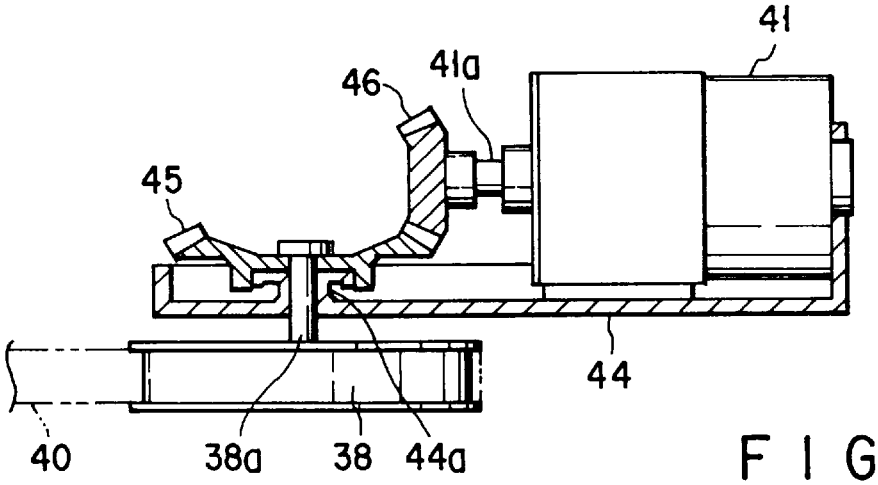
FIG. 6 is a partial cross-sectional view of the open/close drive mechanism.

As shown in FIG. 6, a support shaft 38*a* of the pulley 38 is coupled to a bevel gear 45 through a bearing 44*a* provided in a receiver 44. In other words, the bevel gear 45 and the support shaft 38*a* of the pulley 38 are formed as one body to be rotatably supported by the bearing 44*a*.

A bevel gear 46 engaging with the bevel gear 45 is connected to a rotation shaft 41*a* of the drive motor 41, which is the drive source. The drive motor 41 is a DC motor, which is positively and reversely rotatable. The drive motor 41 is supported by the receiver 44.

As shown in FIG. 5, magnets 47 are attached to free end sides of the filter fixing portion 24*b*, respectively. Magnetic members 48, which are magnetically absorbed by the magnets 47, are attached to the circumferential end frame portion 24*a*, which is opposite to these magnets 47.

In the above-structured indoor unit of the air-conditioner, the decorative panel 24 is normally plane-shaped.

Figure 2:
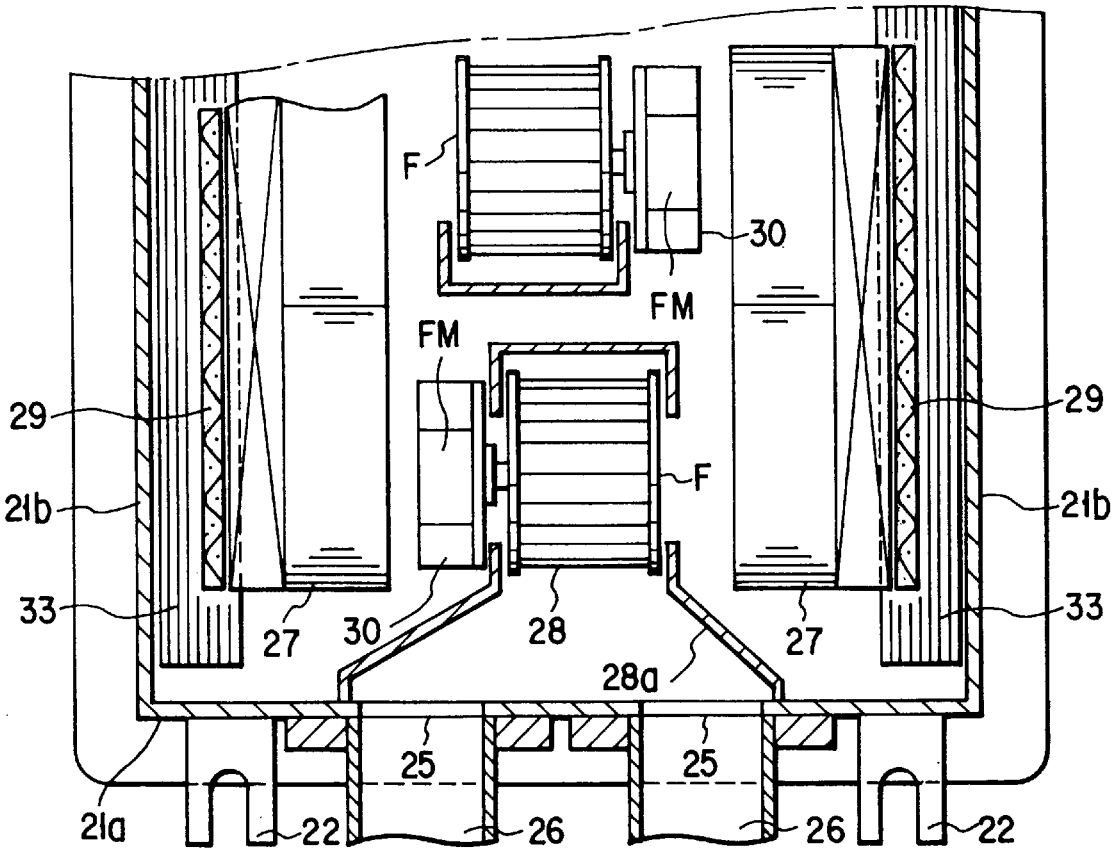
FIG. 2 is a plane view showing the indoor unit partially omitted.

In other words, the magnets 47 attached to the filter fixing portion 24*b* magnetically absorb the magnetic members 48 attached to the circumferential end frame portion 24*a*, so that the filter fixing portion 24*b* is closely attached to the circumferential end frame portion 24*a* and the central panel portion 24*c*. In this state, the filters 29 are placed at the position opposite to the indoor heat exchangers 27 as shown in FIGS. 1 and 2.

A cooling cycle is operated and the blower 28 is driven. Thereby, air in the air-conditioning room R is sucked into the unit body 21 from the inlet port 33. Then, in passing air through the filter 29, dust contained in the air-conditioning room is captured by the filter 29. The air is guided to the indoor heat exchangers 27 to be thermally exchanged, and the thermally exchanged air is blown to a predetermined portion from the blow-off ports 25 through the blow-off ducts 26. Thereby, air blown to the location is air-conditioned.

When the operation for a predetermined period of time is executed or a filter lamp (not shown) is turned on, it is discriminated that the filter 29 is clogged with dust. Then, dust captured by the filter 29 is removed.

At this time, a filter pickup switch, which is provided in a remote controller (not shown), is turned on. As a result, the drive motor 41 of the open/close drive mechanism 35 is electrically driven, so that the bevel gear 46 is driven to be rotated. The bevel gear 45 engaging with the bevel gear 46 is rotated, and the pulley 38 is rotated to a predetermined direction.

The belt 40, which is stretched between the pulleys 38 and 39, is moved forward. At this time, the pin 43 by which one end of each wire 37 is secured is moved. The wire 37 is delivered toward the filter fixing portion 24*b*.

Then, the magnetic combination of each magnet 47 and each magnetic member 48 is released by tare of the filter fixing portion 24*b*. As a result, the free end of the filter fixing portion is gradually moved down.

The filter fixing portion 24*b* is rotated in a state that the support 36 serves as a fulcrum, and opens the circumferential end frame portion 24*a* and the central panel 24*c*. As shown in FIG. 5, the operation of the drive motor 41 is stopped when the filter fixing portion 24 is hung to be a perpendicular state from the ceiling H.

It is assumed that the ceiling H to which the indoor unit is attached is about 2400 mm high from the floor surface. When the position of the filter fixing portion 24*b* is changed to be in substantially a vertical state, the central position of the filter fixing portion is about 1800 mm high from the floor surface, and the lower side end portion of the filter fixing portion is about 1300 mm high from the floor surface.

The filters 29, which are in the vertical position, are placed in front of a worker who exchanges the filters, that is, a position where the worker can reach for the filters. As a result, the worker can easily detach the filters. It is unnecessary for the worker to use the stepladder. Or, it is unnecessary for the worker to stand on tiptoe.

The filters 29 are washed or dust is removed from the filters by a vacuum cleaner. Thereafter, the filters are attached to a predetermined positions of the filter fixing portion 24*b*. Since the position of the filter fixing portion 24*b* is unchanged, the filter fixing can be easily and rapidly performed with safety.

Next, if a filter set button provided on the remote controller is turned on to issue a command for closing the filter fixing portion 24*b*, the drive motor 41 is reversely rotated. The belt 40 is moved backward, and the pin 43 is moved. As a result, the wire 37 is moved in a direction where the wire 37 is pulled.

The free end of the filter fixing portion 24b is moved up, so that the circumferential end frame portion 24*a* is gradually closed. Finally, the filter fixing portion 24*b* contacts a limit switch (not shown), and the drive motor 41 is stopped in a state that the circumferential end frame portion 24*a* is completely closed.

At this time, the current supply to the drive motor 41 is set to be ended for time including time, which is necessary to close the circumferential end frame portion 24*a* by the filter fixing portion 24*b* and time $\alpha$.

As a result, even if the limit switch is troubled and the current supply to the drive motor 41 is not ended, a lock current supply time to the drive motor 41 is set to be short, and the continuous operation of the motor is prevented so as to surely protect the motor.

The magnets 47, which are attached to the filter fixing portion, magnetically absorb the magnetic members 48, which are attached to the circumferential end frame portion 24*a*, in a state that the filter fixing portion 24*b* is closely attached to the circumferential end frame portion 24*a* and the decorative panel 24 is completely formed.

Originally, since the free end of the filter fixing portion 24*b* is maintained to be closed by hanging force of the wire 37, an elongation of the wire is easily generated. However, in the open/close drive mechanism 35, since the magnets 47 and the magnetic members 48 are used, the load applied on the wire 37 can be reduced, and the elongation of the wire can be prevented.

Moreover, the open/close drive mechanism 35 is positioned at the spatial portion 34, which is formed among the drain pan 31, the substrate 32, and the decorative panel 24, so that the effective use of the space can be improved. Then, dust from can be prevented from being adhered onto the structural parts of the open/close drive mechanism 35 with using a cover separately.

Thus, the DC motor, which is positively and reversely rotatable, is used as drive motor 41, and the bevel gear 46 is fixed to the motor to rotate the drive pulley 38 through the bevel gear 45. Thereby, it is possible to restrict the rotation of the drive pulley 38, which is naturally generated. As a result, the filter fixing portion 24*b* can be prevented from being accidentally opened, and safety can be surely obtained.

The formation of the wires 37 is not limited to the above-mentioned embodiment.

For example, in the above embodiment, since one end of each wire 37 is connected to both side portions of the free end, two wires are needed. However, if the wire is connected to only the central portion of the free end, the number of wires may be one.

Moreover, the air-conditioner may be set as follows:

More specifically, the air-conditioner cannot be driven in a state that the filter fixing portion 24*b* is not closed, that is, the filter fixing portion 24*b* does not contact the limit switch.

In other words, it is assumed that the operation start of the air-conditioner is instructed by the remote controller.

If the filter fixing portion 24*b* does not contact the limit switch, the drive motor 41 is driven prior to the operation of the air-conditioner and the filter fixing portion 24*b* is set in the closing state. Thereafter, the air-conditioner is started to be operated.

Therefore, even if the wire 37 is used for a long time, the elongation is generated in the wire 37, and the filter fixing portion 24*b* is slightly opened, the elongation of the wire 37 can be absorbed to prevent the loose of the wire at the operation start time of the air-conditioner.

Figure 7A:
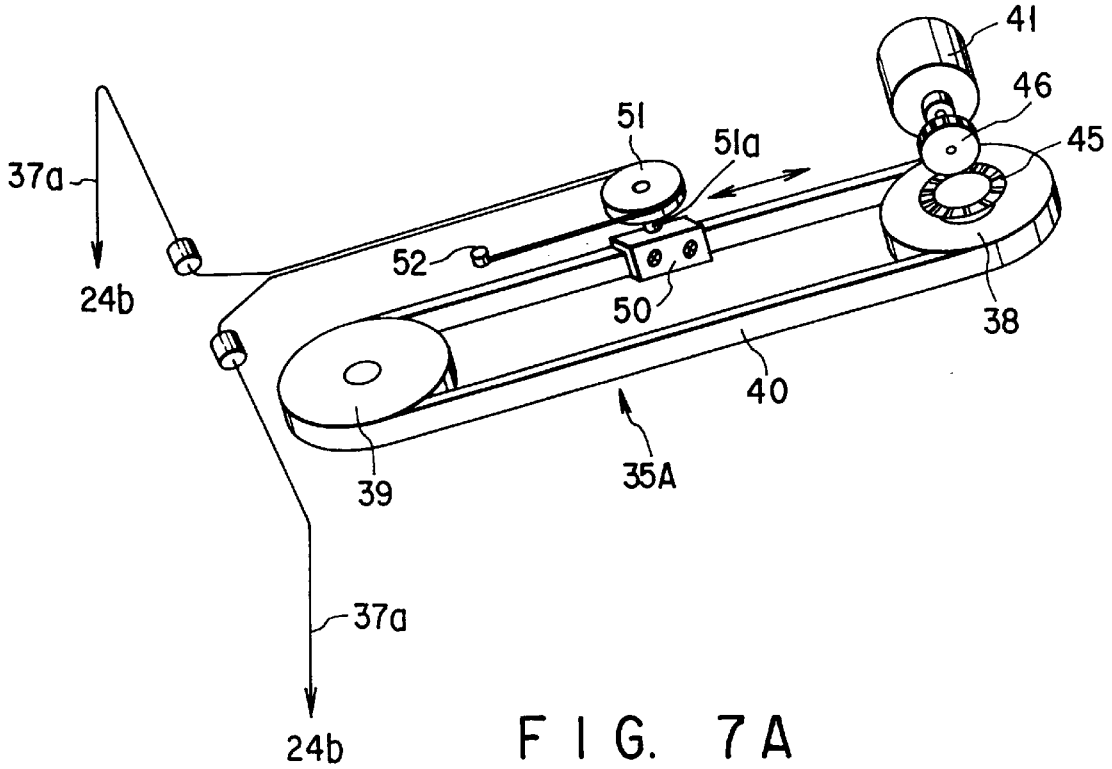
FIG. 7A is a perspective view of the open/close drive mechanism according to a second embodiment of the present invention.
Figure 7B:
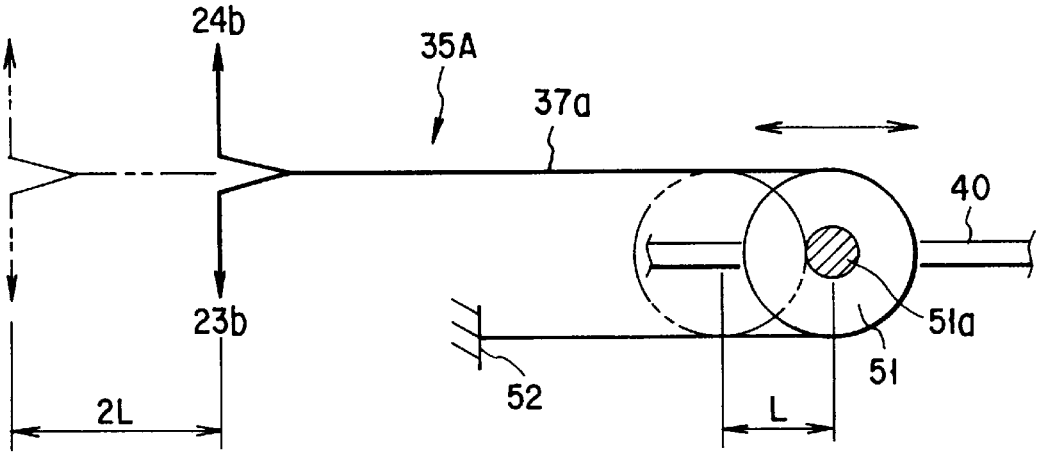
FIG. 7B is a view explaining an operation of the open/close drive mechanisms.

Next, the following will show an open/close drive mechanism 35A according to the second embodiment of the present invention with reference to FIGS. 7A and 7B. In this embodiment, since the structure excepting a movable base 50 is the same as the first embodiment, the same reference numerals are added to the portions common to the first embodiment, and the explanation is omitted.

In this embodiment, the movable base 50 is directly attached to the middle portion of the belt 40. A support shaft 51*a* for supporting a pulley 51 for wire is formed on the movable base 50. Two wires 37*a* are turned back at the pulley 51 in a state that the middle portions of two wires 37*a* are overlaid on each other.

Similar to the previous embodiment, one end of each wire 37*a* is connected to the free end of the filter fixing portion 24*b*. The other end of each wire 37*a* is U-shaped through the pulley 51. These wires 37*a* are fixed to at the pin 52, which is formed close to the belt 40 as a fixing portion, in a state that they are overlaid on each other.

As shown in FIG. 7B, it is assumed that the drive motor 41 is driven with the belt 40 to move the pulley 51 by L. The end portion connected to the filter fixing portion 24*b* of each wire 37*a* is moved by 2L by the principle of pulley.

According to the open/close drive mechanism 35A, the wires 37*a* moves the double distance corresponding to the moving distance of the belt 40. The open/close of the filter fixing portion 24 can be executed for a half time of the case of the open/close drive mechanism 35. As a result, the speed of the filter process can be improved.

Figure 8A:
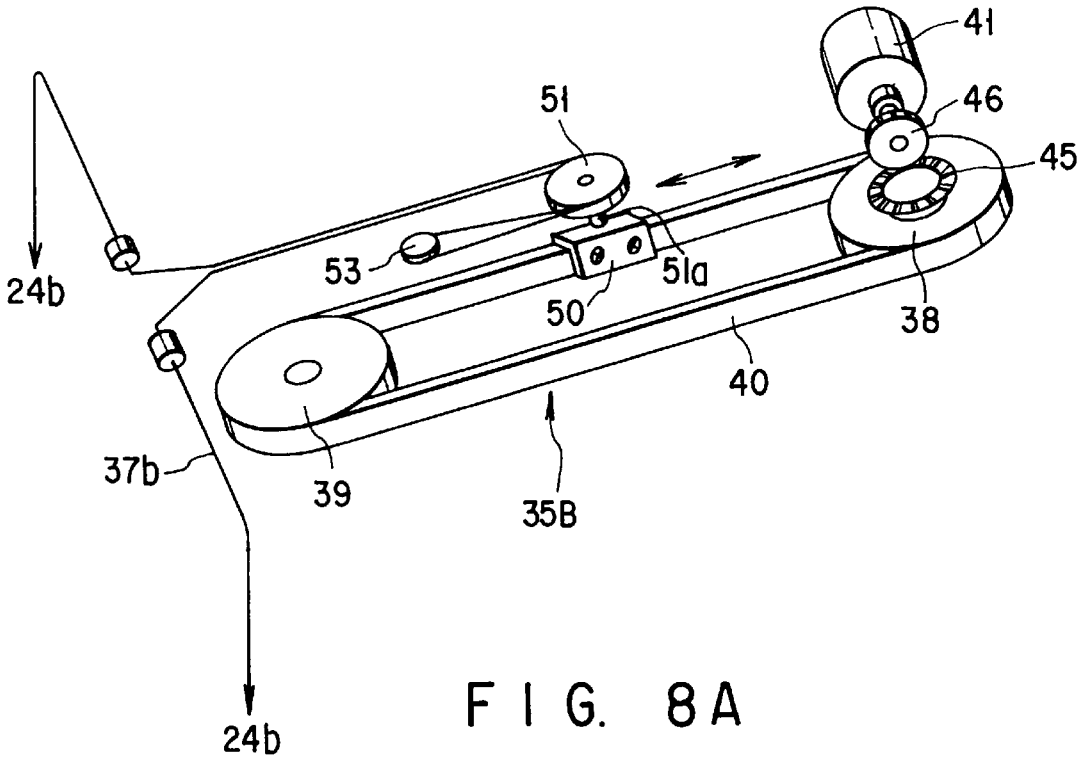
FIG. 8A is a perspective view of the open/close drive mechanism according to a third embodiment of the present invention.
Figure 8B:
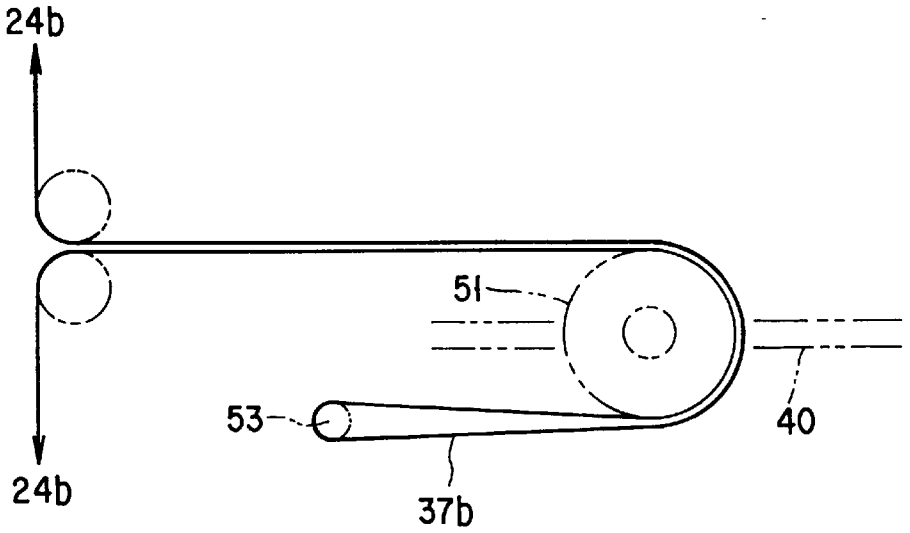
FIG. 8B is a view explaining an operation of the open/close drive mechanisms.

Next, the following will show an open/close drive mechanism 35B according to the third embodiment of the present invention with reference to FIGS. 8A and 8B. In this embodiment, since the structure excepting a wire 37*b* and an idle pulley 53 is the same as the second embodiment, the same reference numerals are added to the portions common to the second embodiment, and the explanation is omitted.

In this embodiment, one long wire 37*b* is used. The intermediate portion of the wire 37*b* is folded in two, and both ends are connected to both sides of the free end of the filer fixing portion 24*b*.

The two-folded intermediate portions of the wire 37*b* are overlaid on each other and turned back at the pulley 51. Further, the two-folded intermediate portions of the wire 37*b* are turned back at the idle pulley 52. The idle pulley 52 itself is freely rotatable, but its support shaft (not shown) is fixed.

In other words, if the drive motor 41 is driven with the belt 40 to move the pulley 51, the end portion connected to the filter fixing portion 24*a* of the wire 37*b* is moved double, so that the filter fixing portion can be opened/closed. As a result, similar to the second embodiment, the speed of the filter process can be improved.

In the above embodiment, the intermediate portion of one wire 37*b* is folded in two. Due to this, even if the elongation is generated in one side of the wire in opening/closing the central panel portion 24*b*, the elongation is absorbed in the other side. As a result, the central panel portion 24*b* is opened/closed without being inclined as its free end sides are maintained to be a horizontal state. The central panel portion 24*b* is closely and uniformly attached to the circumferential end frame portion 24*b* without generating a gap.

In the above-mentioned first to third embodiments, the magnets 47 attached to the filter fixing portion 24*b* magnetically absorb the magnetic members 48 attached to the circumferential end frame portion 24*a*. As a result, no elongation is generated in the wire 37. However, the present invention is not limited to this structure. The present invention may be structured as the following fourth embodiment.

Figure 9:
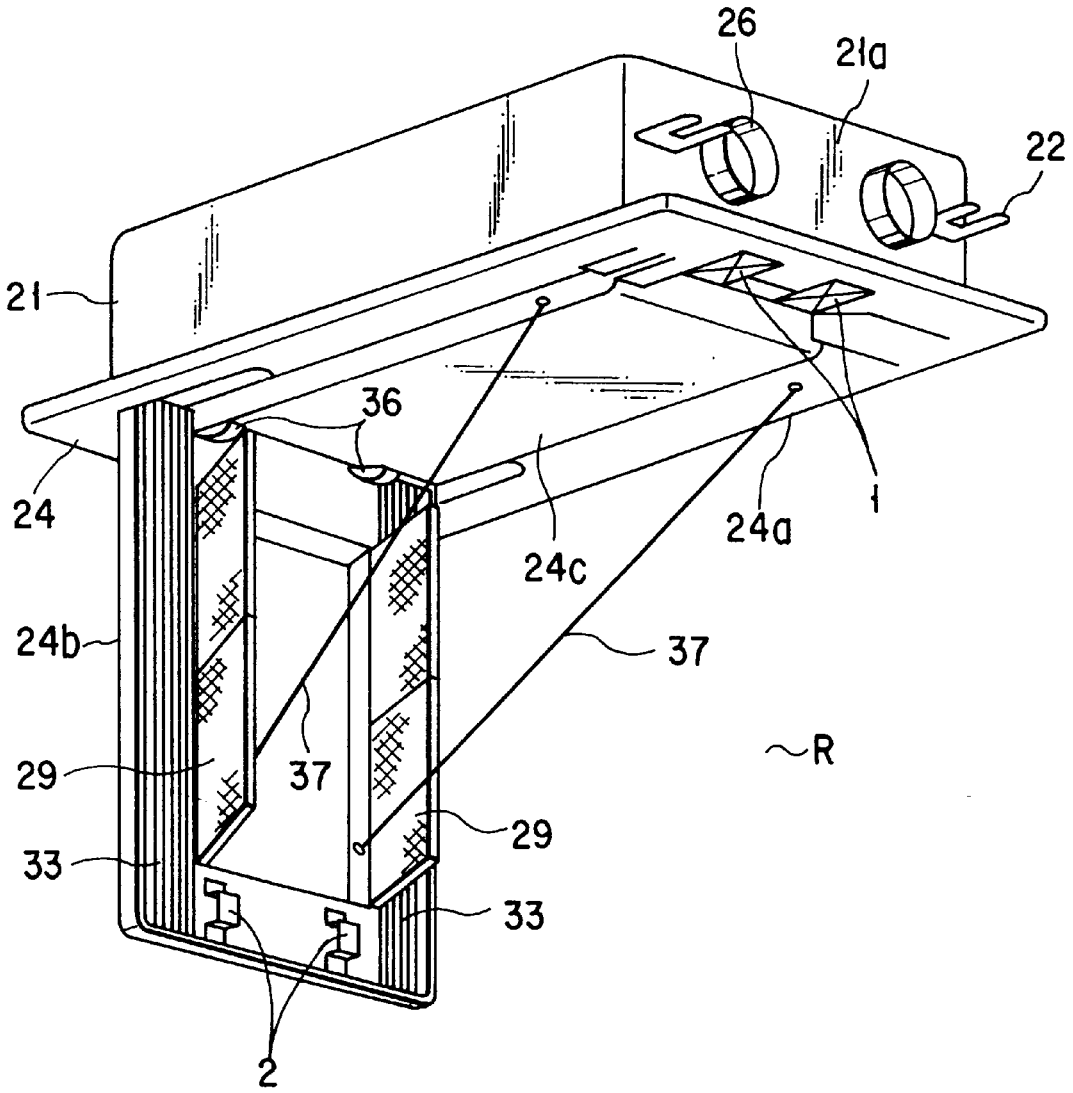
FIG. 9 is a perspective view showing the indoor unit in a state the filter fixing portion is opened according to a fourth embodiment of the present invention.

FIG. 9 is the indoor unit according to the fourth embodiment of the present invention.

In this embodiment, engaging claw portions 2 are used in place of the magnets 47 of FIG. 5, and latch members 1 are used in place of the magnetic members 48. The structure excepting the engaging claw portions 2 and the latch members 1 is the same as the above-mentioned embodiments, the same reference numerals are added to the portions common to the aforementioned embodiments, and the explanation is omitted. Moreover, in this embodiment, the open/close drive mechanism 35 of FIG. 4 is provided in the spatial portion of the central panel 24*c*, and the explanation is also omitted.

According to the fourth embodiment, the latch members 1 are formed close to one end of each wire 37 of the circumferential end frame portion 24*a*. The engaging claw portions 2 are formed on the filter fixing portion 24*a*, which is opposite to the latch members 1.

Figure 10:
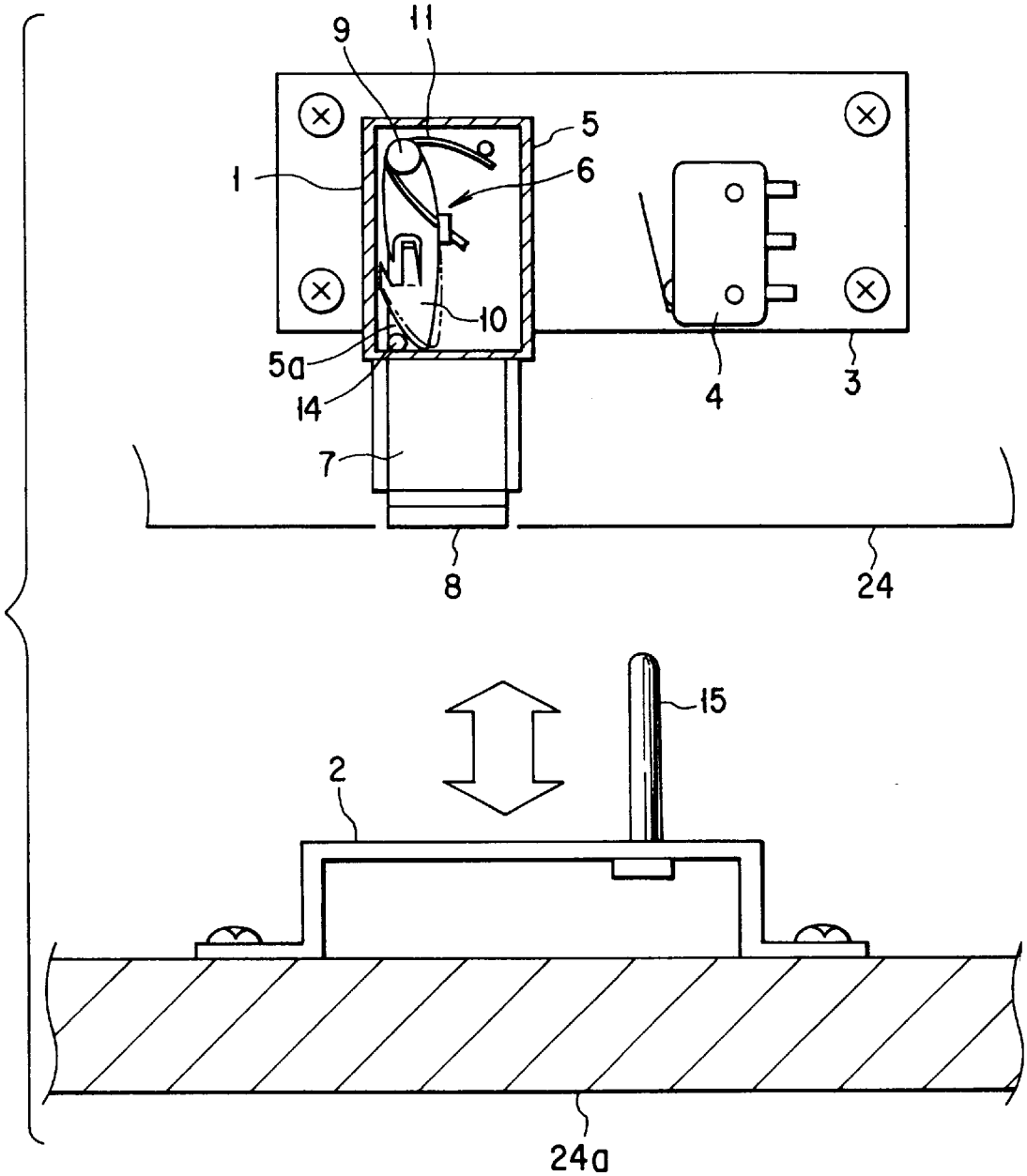
FIG. 10 is a view showing an operation of an engaging portion and an engage claw portion.
Figure 11:
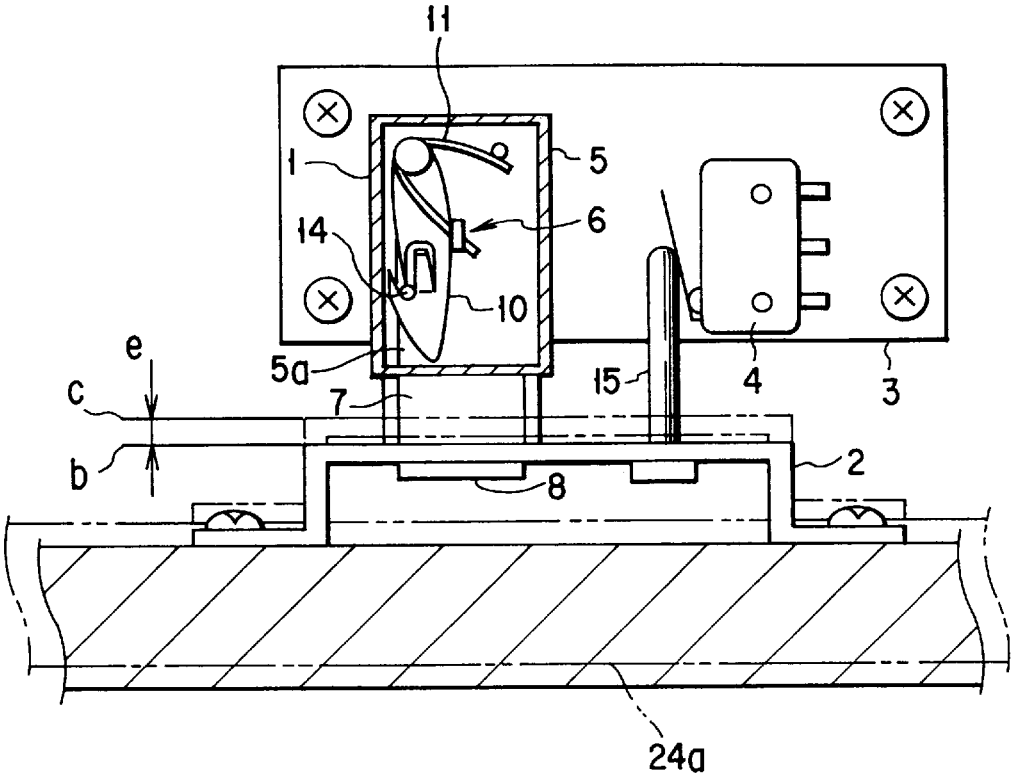
FIG. 11 is a view showing an operation of an engaging portion and an engage claw portion whose state is different from the case of FIG. 10.

The latch member 1 and the engaging claw portion 2 are structured as shown in FIGS. 10 and 11. FIG. 10 shows the state that the filter fixing portion 24*b* is opened, and FIG. 11 shows the state that the filter fixing portion 24*b* is closed.

The latch member 1 is fixed to a support plate 3 formed at a predetermined portion of the decorative panel 24. A detection switch 4 is fixed to the support plate 3 to detect the containing state of the filter fixing portion 24*b* to be described later.

The latch member 1 comprises a latch body 5, which is attached to the support plate 3 by suitable means and which has a central axis set to a perpendicular direction, a latch mechanism 6 contained in the latch body 5, an actuation rod 7 and a hook 8.

The latch mechanism 6 a support pin 9, a cam 10, a spring 11, and a compression spring (not shown). The support pin 9 is formed in the latch body 5, and the cam 10 is rotatably supported by the support pin 9. The spring 11 is elastically urged to be rotated clockwise. The compression spring is elastically urged to be pressed in a lower direction.

Figure 12A:
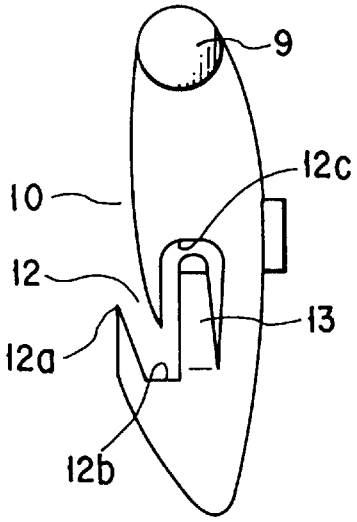
FIG. 12A is a front view showing a cam used in the engaging portion.
Figure 12B:
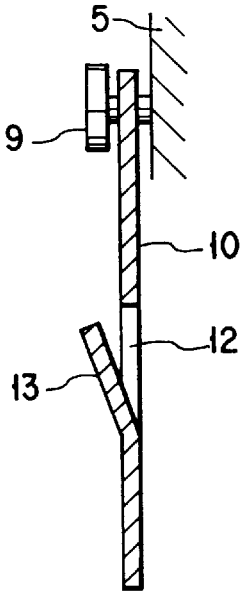
FIG. 12B is a vertical cross-sectional view of the cam.

As shown in FIGS. 12A and 12B, a groove portion 12 is obliquely formed to the lower portion from the side end of the cam 10. More specifically, the groove 12 is formed to the upper portion, which is the central portion of the cam, from the obliquely lower bottom portion to be substantially V-shaped. The opening end of the groove portion 12 is a top end portion 12*a*, and the lowest end is a bottom portion 12*b*, and the uppermost end of the groove portion is an upper end portion 12*c*.

A tongue piece 13 is blanked out to provide a raised portion along the upper end portion 12*c* from the bottom portion 12*b*. In other words, the tongue piece 13 is blanked out to provide the raised portion, which is placed on one side surface of the cam 10 and which is opposite to the latch body 5.

As shown in FIGS. 10 and 11, again, the actuation rod 7 is formed to be partially projected from the lower surface portion of the latch body 5. Then, the actuation cords 7 are freely lifted up and down by the latch body 5.

A guide groove 5*a* is formed in up and down directions. An actuation pin 14, which is formed on the actuation rod 7 to be projected, is always engaged with the guide groove 5*a*. The pin 14 is guided along the up and down directions.

Particularly, as shown in FIG. 10, the actuation rod 7 is moved in the lower direction and the actuation pin 14 is engaged with the lower end portion of the guide groove 5*a*, thereby, the actuation rod 7 is projected to the lowermost, and the position is restricted. Also, as described later, the actuation rod 7 is moved in the upper direction and the actuation pin 14 is engaged with the upper end portion 12*c* of the cam 10. Thereby, the actuation rod 7 is moved uppermost, and the position is restricted.

The hook 8 is structured such that its upper end portion (not shown) is rotatably supported by the actuation rod 7. On the upper end support portion, a spring is provided to be elastically urged in a direction where the hook is opened. The lower end portion of the hook 8 is horizontally curved in a front direction such that its cross section is substantially L-shaped.

In other words, the hook 8 is moved up and down together with the up and down movement of the actuation rod 7. Also, the amount of the rotation is restricted in accordance with the amount of the projection from the latch body 5.

For example, as shown in FIG. 10, in the state that the actuation rod 7 is projected lowermost, the hook 8 forms the maximum rotation angle. If the actuation rod 7 is moved up from this state, the hook 8 is also moved up.

In a state that the actuation rod 7 is moved up with a predetermined amount, the hook 8 is slid to the opening end portion of the latch body 5. If the actuation rod 7 is further moved up, the hook 8 is restricted by the opening end portion, so that the rotation angle is decreased against the elastic force of the spring and the hook 8 is in a close state.

Before the actuation rod 7 reaches the position of FIG. 11, the rotation amount of the hook 8 is completely zero, and the half or more of the hook 8 is contained in the latch body 5 together with the actuation rod 7. If the actuation rod 7 is moved down from the position of FIG. 11, it is needless to say that the hook 8 performs the operation, which is completely opposite to the above-mentioned operation.

The detection switch 4, which is fixed to the support plate 3 together with the latch body 1, is a limit switch, and its operation is described later.

The engaging claw portion 2 on the filter fixing 24*b* is formed of a plate piece, which is curved like a hat. The engaging claw portion 2 is placed at the position corresponding to the limit switch 4 depending on the position of the filter fixing portion 24*b*. A switch push rod 15 is provided on the engaging claw portion 2. The switch push rod 15 comes into contact with the limit switch 4, thereby turning it ON, depending on the position of the filter fixing portion 24*b*.

Figure 13:
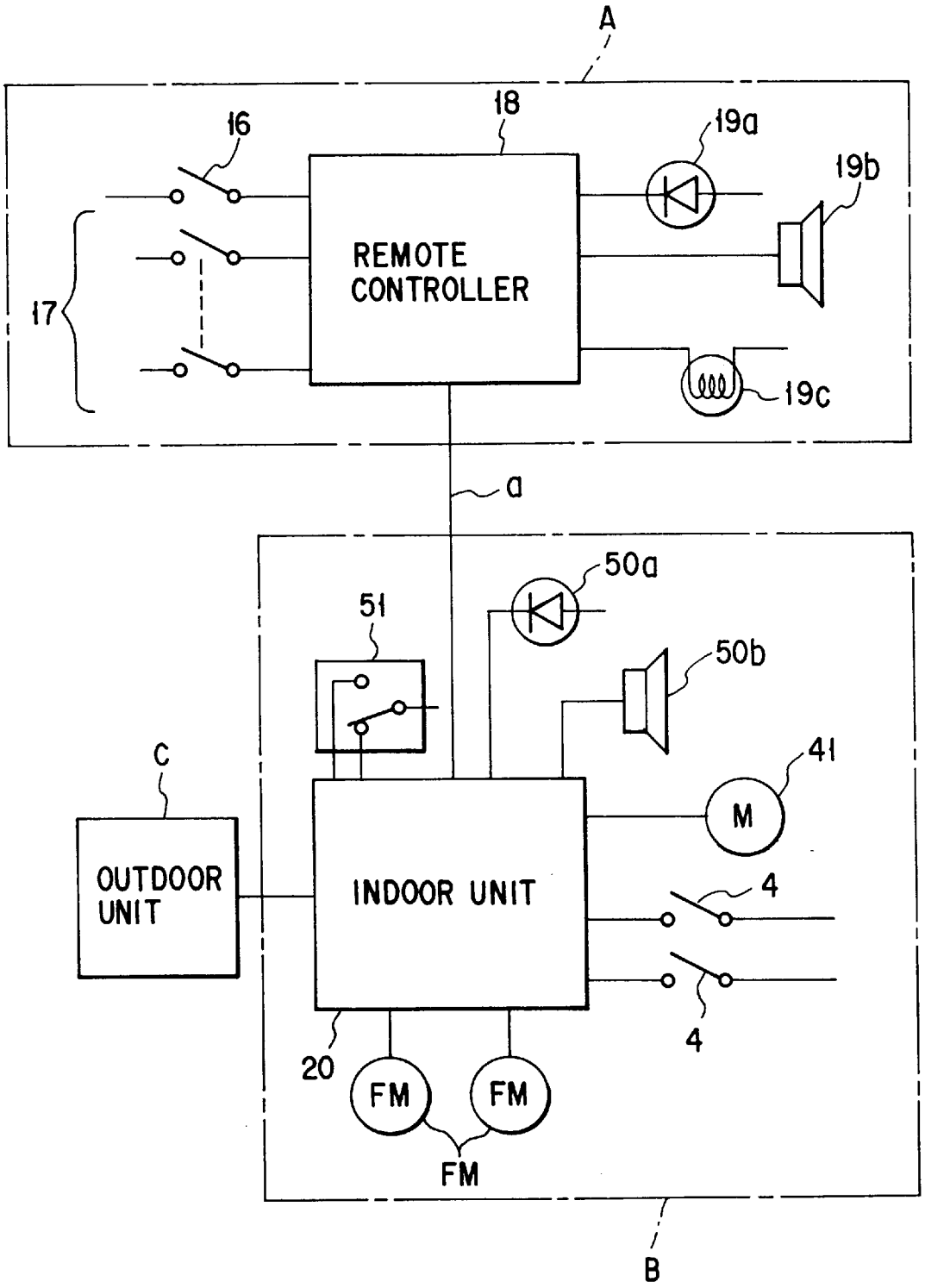
FIG. 13 is a block diagram of the air-conditioner.

FIG. 13 shows a control block in the air-conditioner.

The air-conditioner comprises a remote controller A, which is a remote operation panel, an indoor unit B, and an outdoor unit C.

The remote controller A comprises a filter lift switch 16 and a plurality of operation switches 17 for stopping the operation of the air-conditioner, setting a room temperature, setting an amount of fan air of the indoor unit, etc.

Then, switches 16 and 17 are connected to a control circuit 18, which comprises a microcomputer, etc. In accordance with the input of these switches, the control circuit 18 sends instruction signals of various kinds of operations to the indoor unit B through a communication line a in accordance with these switch inputs.

The remote controller A further comprises a lift abnormality displaying LED 19*a*, a lift alarm buzzer 19*b*, and a filter lift alarm lamp 19*c*. The LED 19*a* displays abnormality when abnormality is generated during the lifting operation of the filter 29. The lift alarm buzzer 19*b* is a movement alarm device for giving an alarm during the lifting of the filter 29. The filter lift alarm lamp 19*c* turns on and off the lifting operation of the filter on the display panel of the remote controller A. These operations are controlled by the control circuit 18.

The indoor unit B comprises a control circuit 20. The control circuit 20 receives the instruction signals sent from the control circuit 18 of the remote controller A through the communication line a. Then, the control circuit 20 controls the various kinds of devices of the indoor unit in accordance with the instruction signals, and sends the instruction signals to the outdoor unit C through the communication line a.

The devices controlled by the control circuit 20 of the indoor unit B are two fan motors FM, the motor 41, two limit switches 4, a lift abnormality displaying LED 50*a*, a lift alarm buzzer 50*b*, and switches 51 serving as lift-off distance setting means.

The fan motors FM are used for the blower 28 for blowing heat exchange air to the ducts 26. The motor 41 positively and reversely rotates to lift up and down the filter fixing portion 24*b* through the wire 37. The limit switches 4 detect the containing state of the filter fixing portion 24*b* by contacting a switch push rod 15. The LED 50*a* displays abnormality when abnormality is generated during the lifting operation of the filter fixing portion 24*b*. The lift alarm buzzer 50*b* gives an alarm during the lifting of the filter fixing portion 24*b*.

The switches 51 set the lift-off distance of the filter fixing portion 24*b* based on the condition of mounting the indoor unit B. The switching is set in mounting the indoor unit B.

More specifically, two kinds of switches 51 are prepared. One is used for a large lift-off distance in mounting the indoor unit B on the high ceiling of a house, and the other is used for a small lift-off distance in mounting the indoor unit B on the low ceiling of an apartment house. Either switch is selected.

Moreover, the outdoor unit C has a cooling cycle device such as a compressor, and an outdoor controller, which communicates with the control circuit 20 of the indoor unit B to control the operation of the cooling cycle device.

Then, after the above-structured air-conditioner is operated for a predetermined period of time, dust captured by the filter 29 is removed or the filter 29 is replaced with new one.

At this time, the filter lift switch 16 of the remote controller A is turned on. As a result, the current is supplied to the motor 41 of the open/close drive mechanism 35 of FIG. 4, and the motor 41 is once positively rotated. A worm 46 is rotated. Then, a worm gear 45 engaging with the worm 46 is rotated, and the drive pulley 38 is rotated in a positive direction.

The belt 40, which is stretched between the pulleys 38 and 39, is started to move forward. At this time, the pin 43 fixing one end of the wire 37 is moved.

The wire 37 is pulled up, and the filter fixing portion 24*b* connected to the other end portion of the wire is rotated in a state that the support portion 35 is used as a fulcrum, and the free end is moved up to a predetermined distance. In this state, the engaging claw portions 2 on the filter fixing portion 24*b* are released from the latch body 1 on the decorative panel 24 to be described later.

Next, the motor 41 is reversely rotated, and the open/close mechanism 35 is actuated in the opposite direction to rotate the free end of the filter fixing portion 24*b* downward. As a result, the filter fixing portion 24*b* opens the circumferential end frame portion 24*a* and the central panel 24*c*.

As shown in FIG. 9, the operation of the motor 41 is stopped when the filter fixing portion 24*b* is set in substantially a vertical state. The height of the filter fixing portion 24*b* in this state is the same as the case previously explained. Therefore, the filter can be easily detached.

In opening the filter fixing portion 24*b*, the lift-off distance can be changeably set in advance. For example, in the case of the house with a high ceiling, the filter fixing portion 24*b* is set to be substantially a vertical state. In the case of the apartment house with a low ceiling, the filter fixing portion 24*b* is opened in an oblique state. In any case, there is considered danger, which is caused when the habitant contacts the filter fixing portion, can be prevented.

Next, the following will explain the operation of the latch body 1, which includes the state that the engaging claw portion 2 is engaged with the latch body 1 to the state that the engaging claw portion 2 is completely released from the latch body 1, in order.

The state that the latch 1 engages the engaging claw portion 2 is shown in FIGS. 11 and 14(A). The engaging claw portion 2 is engaged with the horizontal portion of the hook 8, which is substantially L-shaped.

Thus, since the filter fixing portion 24*b* having the filter 29 is supported by only the latch body 1, there is no load applied to the wire 37, and no elongation is generated.

The end surface of the actuation rod 7 elastically contacts the engaging claw portion 2. The fixing position of the engaging claw portion 2 due to the latch 1 is a position b as shown in FIG. 14(A).

Figure 14:
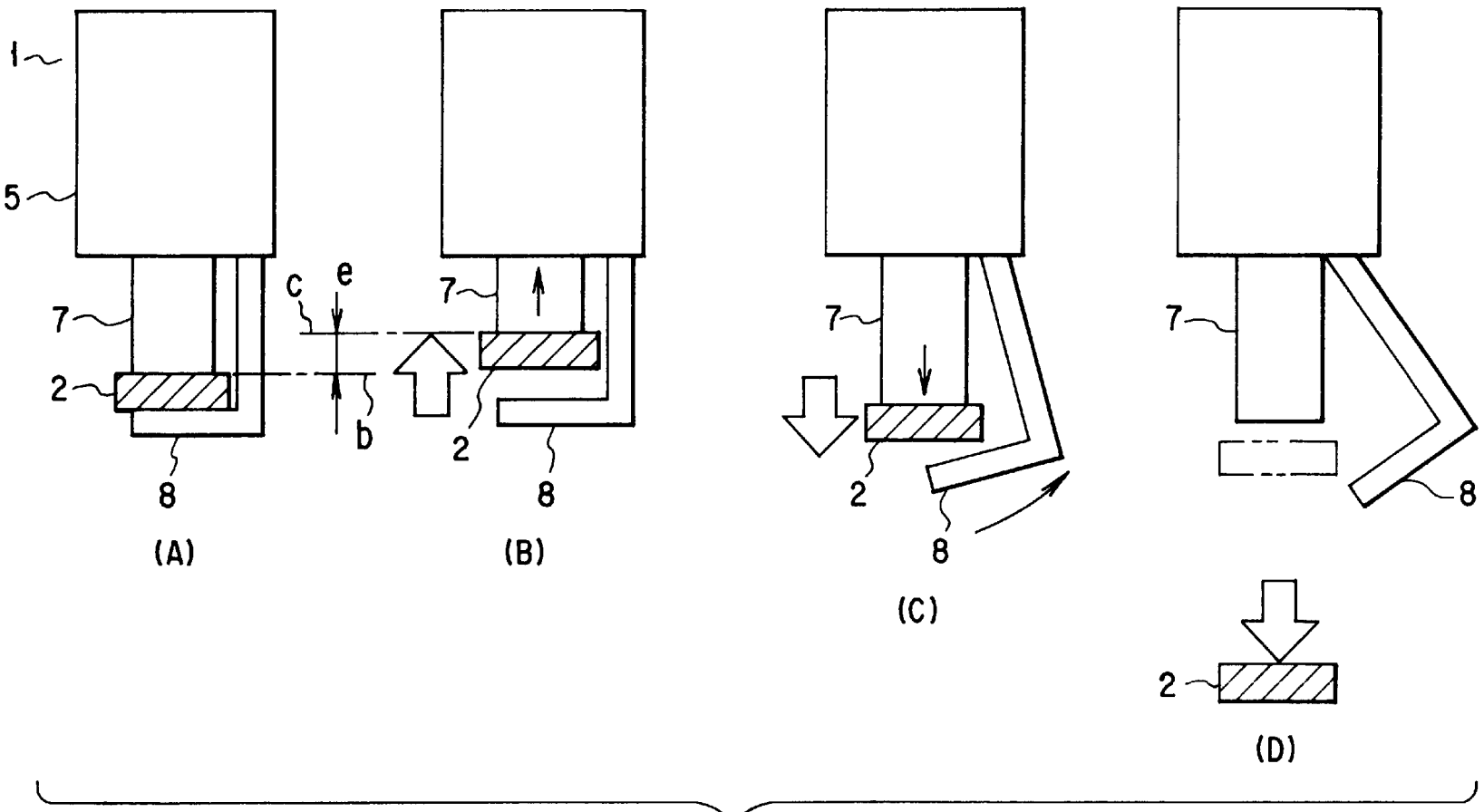
FIG. 14 is a view explaining the function till a latch member engaging the engage claw portion releases the engaging claw portion in order of (A) to (D)

By the function of the open/close drive mechanism 35, the filter fixing portion 24*b* and the engaging claw portion 2 are once moved up to a position c, which is called an upper dead point, as shown by a two-dotted chain line of FIG. 11 or (B) of FIG. 14.

The above move-up operation is called "increase." This is the operation for releasing the engagement of the latch body 1 with the engaging claw portion 2 to open the claw portion. A distance e of the increase is 3 mm.

The engaging claw portion 2 placed at the position b is spaced from the hook 8 and pushes up the actuation rod 7 against the elastic force of the compression spring, so that the increase distance 3 rises. In a latch mechanism portion 6, the actuation pin 14 on the actuation rod 7 moves up to the upper end portion 12*c* from the bottom portion 12*b*. The pin 14 is engaged with the upper end portion, and the rise is restricted.

In other words, the actuation rod 7 rises to the upper dead point together with the engaging claw portion 2. At this time, since the engaging claw portion 2 is spaced from the hook 8, the engaging claw portion 2 is released from the hook 8 under this state.

Next, the open/close drive mechanism 35 drives to lift down the engaging claw portion 2 together with the filter fixing portion 24*b*. As shown in (C) of FIG. 14, an elastic return force of the compression spring works on the actuation rod 7, so that the actuation rod 7 is pressed down.

The actuation rod 7 follows the engaging claw portion 2, and moves down. The hook 8 rotates in the inclined direction in the middle of the descent, and the engaging claw portion 2 continues to move down without being hooked by the hook 8. At the same time, the reaction force of the spring, which engages with the support portion of the hook, acts on the actuation pin 14.

As a result, the top end surface of the actuation pin 14 contacts the tongue piece 13, which is formed along the groove 12. Moreover, the rotation angle of the hook 8 is increased with the descent of the actuation rod 7, so that the top end portion of the actuation pin 14 is elastically slid to the tongue piece 13.

Finally, the actuation pin 14 is slid along the side surface of the cam 10 from the lower end portion of the tongue piece 13. Then, the actuation pin 14 goes over the lower end portion of the cam 10. As a result, as shown in FIG. 10, the actuation pin 14 is engaged with the lower end portion of the guide groove 5*a* of the latch body 5, and the decent of the actuation rod 7 is restricted. At this time, almost all parts of the hook 8 are projected. As shown in (D) of FIG. 14, the engaging claw portion 2 is completely released from the latch body 1, and the decent of the filter fixing portion 24*b* is completely free together with the engaging claw portion 2.

The filter fixing portion 24*b* is opened, and the filter 29 is cleaned or replaced with new one. Thereafter, the filter lifting switch 16 of the remote controller A is turned on to output a closing instruction of the filter fixing portion 24*b*.

The motor 41 positively rotates to drive the belt 40 and to move the wire 37 in a direction where the wire 37 is pulled. As a result, the free end of the filter fixing portion 24*b* is pulled up. The filter fixing portion 24*b* gradually closes the circumferential end frame portion 24*a*.

Finally, the filter fixing portion 24*b* completely closes the circumferential end frame portion 24*a*. At this time, the open/close drive mechanism 35 once moves up the filter fixing portion 24*b* to the upper dead point c over the engaging position b to form the increase with distance e.

Then, the motor 41 is reversely rotated at the upper dead point c to move down the filter fixing portion 24*b* by distance e. Thereby, the filter fixing portion 24*b* is engaged with the latch body 1.

Next, the following will explain the operation of the latch body 1, which includes the state that the filter fixing portion 24*b* is released from the latch body 1 to the state that the engaging claw portion 2 is engaged with the latch body 1, in order.

FIGS. 10 and 15(A) show the state that the engaging claw portion 2 is completely released from the latch body 1. At this time, a projection quantity of the actuation rod 7 and a rotation quantity of the hook 8 are set to the maximum, respectively.

The actuation pin 14 of the actuation rod 7 is engaged with the lower end portion of the guide groove 5*a* of the latch body 5 as explained above.

The engaging claw portion 2 moves up in accordance with the rise of the filter fixing portion 24*b*. Finally, as shown in (B) of FIG. 15, the engaging claw portion 2 contacts the lower end surface of the actuation rod 7 to move up the actuation rod 7. Since the actuation pin 14 moves up as contacting the end surface of the cam 10, the cam 10 is urged to be rotated anticlockwise against the elastic force of the spring 11.

The hook 8 also moves up in accordance with the rise of the actuation rod 7. Then, the hook 8 is restricted by the latch body 5 to start to be rotated. After the engaging claw portion 2 passes, the horizontal portion of the hook 8 moves to the lower portion of the engaging claw portion 2. In this case, the hook 8 and the engaging claw portion 2 do not contact each other.

Figure 15:
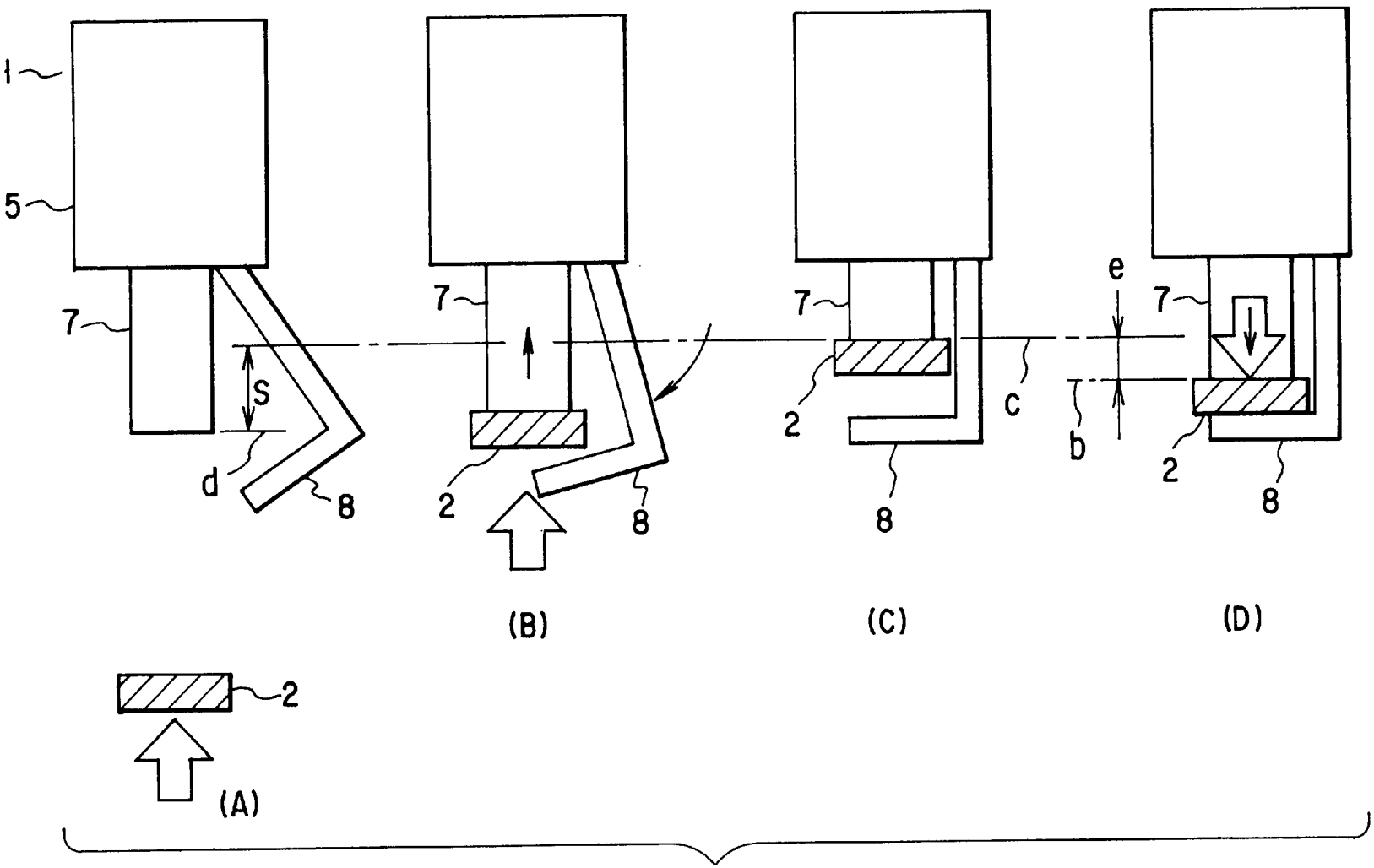
FIG. 15 is a view explaining the function till the latch member releasing the engage claw portion engages with the engaging claw portion in order of (A) to (D)

As shown in (C) of FIG. 15, when the actuation rod 7 reaches the upper dead point c, the actuation pin 14 goes over the top end portion 12*a* of the groove 12 formed on the cam 10. The force for restricting the cam 10 is instantaneously removed, and the elastic force of the spring 11 acts on the cam 10. As a result, the cam 10 is urged to be rotated clockwise.

The actuation pin 14 is positioned at an inlet portion of the groove 12. At this time, the hook 8 is set to be in an engaging state with the engaging claw portion 2. However, the hook 8 is spaced from the claw portion by a predetermined distance, and the engagement is not established.

Next, the open/close drive mechanism 35 reversely rotates the motor 41 so as to move down the engaging claw portion 2 by increase e, which is from the upper dead point c to the fixing position b. In accordance with this movement, the elastic force of the compression spring for pressing the actuation rod 7 acts on the actuation rod, so that the actuation rod is moved down. In this case, the position of the hook is unchanged.

Then, the elastic spring force of the spring 11 acts on the cam 11, so that the cam 10 is rotated clockwise. The actuation pin 14 is guided to the bottom portion 12*b* of the groove 12. Finally, as explained in FIG. 11, the pin 14 is engaged with the groove bottom portion 12*b*, so that the descent is restricted.

Also, as shown in (D) of FIG. 15, the engaging claw portion 2 is engaged with the book 8. Since the elastic force of the compression spring acts on the actuation rod 7, the rod 7 contacts the engaging claw portion 2 as it is.

In this case, a pressing stroke S of the latch body 1 is a distance between the pressing start position b, which is the position where the actuation rod 7 is projected most, and the upper dead point c, which is the pressing end position as shown in (A) of this figure.

Then, the limit switch 4 to be described later discriminates the containing state over the entire range of the pressing stroke of the latch 1.

Next, the above-mentioned operation will be explained by the control flow chart.

Figure 16:
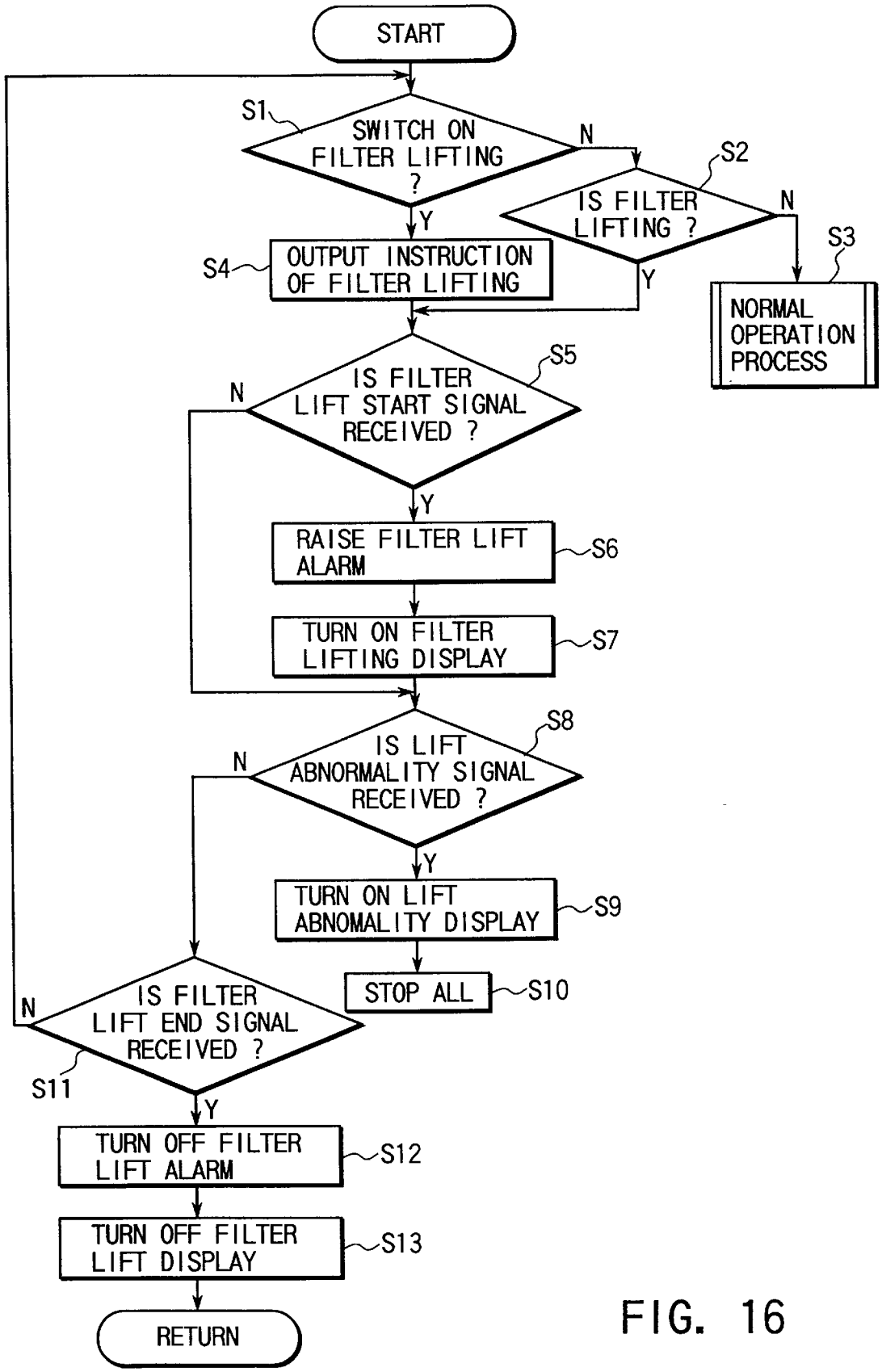
FIG. 16 is a flow chart of a remote controller.

As shown in FIG. 16, the control circuit 18 of the remote controller A checks whether or not a filter lilting switch 16 is turned on in step SI.

If the filter lifting switch 16 is not turned on (N), the operation goes to step S2, and it is checked whether or not the filter 29 is lifting in the present indoor unit B.

This operation is performed based on a filter lifting start signal sent from the control circuit 20 of the indoor unit B to be described later and an ending signal. In other words, it is discriminated that the filter 29 is lifting until the ending signal is received after receiving the filter lifting start signal is received.

If it is checked that the filter 29 is not lifting in step S2, the operation goes to a step S3, and an operation process, serving as an air-conditioner for a normal cooling or heating, is performed.

On the other hand, if the filter lifting switch 16 is turned on (N), the operation goes to step S4, a filter lifting instruction is sent to the indoor unit control circuit 20 through a communication line a.

Sequentially, in step S5, for driving the motor 41 of the open/close drive mechanism 35 to actually lift the filter fixing portion 24*b*, it is discriminated whether or not the filter lift start signal to be output to the remote controller A from the indoor unit control circuit 20 is received.

If the lift start signal is received (Y), the operation goes to step S6, and the lift alarm buzzer 19*b*, which is the alarm device for movement, is turned on, thereby giving a filter lift alarm. Then, in step S7, the filter lift alarm lamp 19*c* formed on the rear of the display panel is periodically turned on, thereby displaying the lift of the filter 29.

Thereafter, the operation goes to step S8. In step S8, it is discriminated whether or not a lift abnormality signal for informing that abnormality is generated in lifting the filter 29 is sent from the indoor unit control circuit 20.

If the abnormality signal is received (Yes), a lift abnormality display LED 19*a* is turned on in step S9, and the air-conditioner is completely stopped and the following operation is not received in step S10.

If the abnormality signal is not received (No) in step S5, the operation jumps to step S8 to discriminate whether or not the lift abnormality is present.

If the abnormality signal is not received (No) in step S8, the operation goes to step S11, and it is discriminated whether or not the lift end signal of the filter 29 is sent from the indoor unit control circuit 20.

If the abnormality signal is received (Yes) in step S11, the operation goes to step S12, and the lift alarm sound of the lift alarm buzzer 19*b*, which is set in step S6, is stopped. Moreover, in step S13, the filter lift alarm lamp 19*c* on the operation panel 19*b* is ended.

If the abnormality signal is not received (No) in step 11, the operation goes back to step S1. Then, if it is discriminated that the filter is lifting in step S2, the operation goes to step S5.

According to the above-explained control operation, if the user operates the filter lift switch 16, the operation is discriminated in step S1, and the filter lift instruction is output to the indoor unit B. Thereby, the lift of the filter fixing portion 24*b* is started. Then, the filter lift start signal is output from the indoor unit B is output, and this operation is discriminated in step S5.

Sequentially, if the user turns on the filter lift switch 16 in a state that the filter is already moved down, the operation is discriminated in step S1 again, and the filter lift instruction is output in step S2.

Since the filter 29 is already moved down in the indoor unit B, the rise of the filter is started. At the time when the filter 29 reaches at a predetermined position, the filter lift end signal is output.

The filter lift end signal is discriminated in step S11, and the lift movement of the filter 29, that is, the filter cleaning by the user or the replacement is ended.

Then, during the time from the filter lift-down start (filter lift start signal receiving) to the filter lift-up end (filter lift end signal receiving), the filter lift alarm sound of the buzzer 19*b* raises, and the lift alarm lamp 19*c* is turned on in step S7.

Also, if the abnormality is generated in the middle of the lifting of the filter 29 and when the answer is YES in step S8, the lift abnormality display LED 19*a* is turned on in step S9 and the operation is stopped in step S10, and the following operation is not received in step S10.

During the time when the filter fixing portion 24b is lifted down, the filter 29 is detached, and replaced with new one, the operations in steps S1, S2, S5, S8, and S11 are repeatedly performed.

Figure 17:
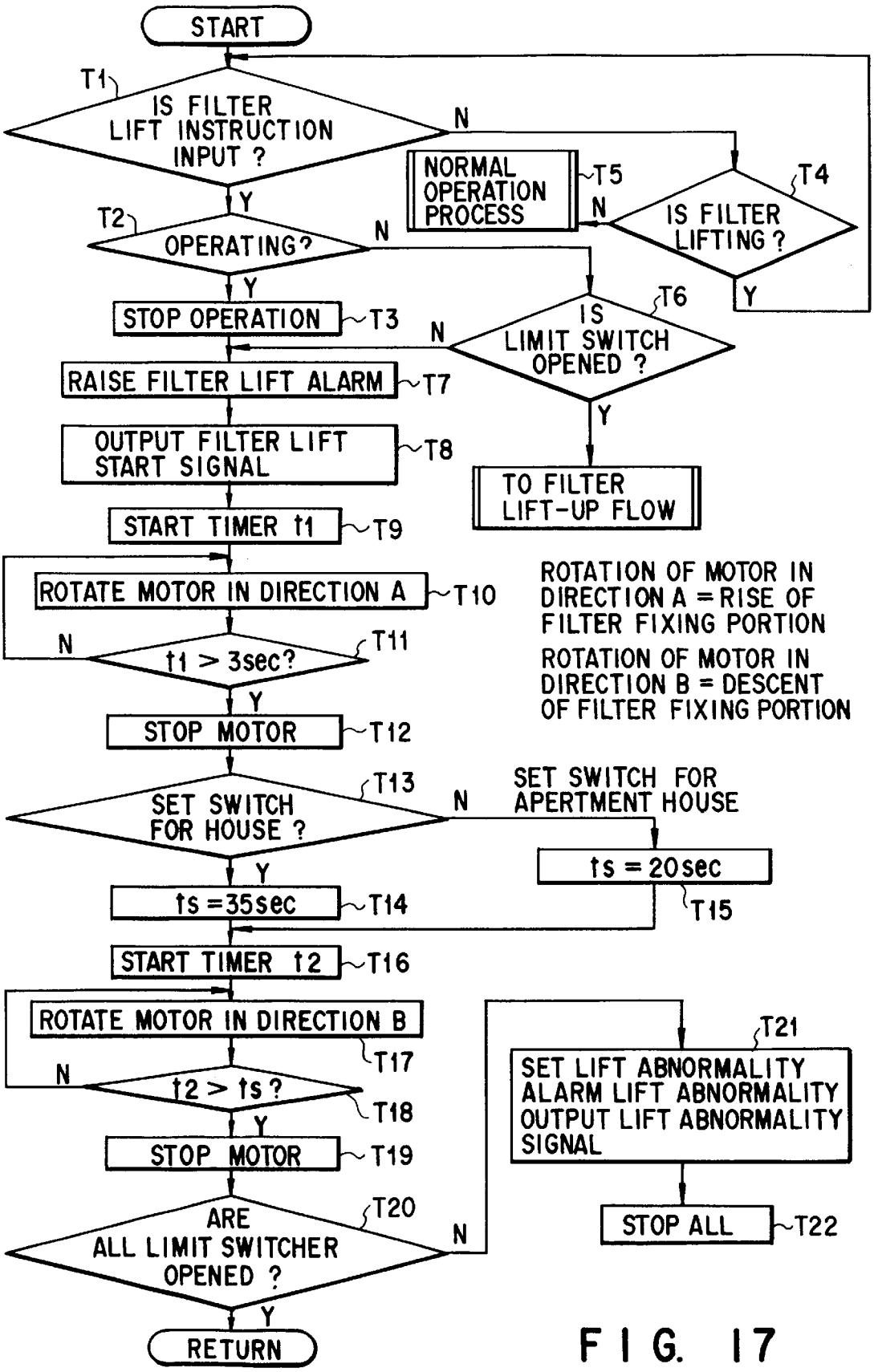
FIG. 17 is a flow chart explaining the opening of the filter fixing portion.

Next, the following will explain the control flow chart of the indoor unit B with reference FIG. 17.

In step T1, it is discriminated whether or not the filter lift start signal is input from the remote control A.

If the filter lift instruction input (Yes), the operation goes to step T2. In step T2, it is discriminated whether or not the indoor unit B is operated. If it is operated, all operations of such as a blower 28 are stopped.

On the other hand, if it is discriminated that the filter instruction is not input (No), the operation goes to step T4. In step T4, it is discriminated whether or not the filter 29 is lifting now.

If the filter 29 is lifting (Yes), the steps T1 and T4 are repeated until a next filter lift instruction is input. If the filter 29 is not lifting (No), the operation goes to step T5, and the normal operation is performed.

If the indoor unit B is not operated (No) in step T2, the operation goes to step T6. In step T6, the opening/closing state of the limit switch 4 for detecting the state of the filter fixing portion 24*b* is discriminated.

If the limit switch 4 is opened (Yes), it is discriminated that the filter fixing portion 24*b* is lifted down. Then, the filter 29 is contained in the indoor unit B in accordance with the filter lift instruction. Due to this, the operation goes to a filter rise flow to be explained in FIG. 18.

On the other hand, if the operation is stopped in step T3 and the limit switch 4 is closed, the filter fixing portion 24*b* is contained in the indoor unit B, so that the descent of the filter 29 is started.

In the descent of the filter 29, the filter lift alarm sound is given by a lift alarm buzzer in step T7. In step T8, the lift start signal of the filter 29 is output to the control circuit 18 of the remote controller A in step T8.

Then, in step T9, the counting of timer t1 for a latch release is started. Sequentially, in step T10, the motor 41 of the open/close drive mechanism 35 is rotated in a direction A where the filter fixing portion 24*b* rises to release the engaging claw portion 2 from the latch body 1.

Next, the operation goes to step T11, it is discriminated whether or not counting time of timer t1 exceeds 3 seconds.

As the motor 41, there is used a DC motor with a brush, which has a planetary gear inside, and which prevents the rotation from the output shaft. The number of rotations of motor 41 is proportional to the operation (electrical conduction) time.

The rising distance of the filter fixing portion 24*b*, which is moved up through the wire 37, is also proportional to the number of rotations of motor 41. Due to this, the amount of the rise and that of the descent of the filter fixing portion 24*b* can be controlled by controlling the rotational direction of the motor 41 and the operation time.

In this case, the filter fixing portion 24*b* rises in accordance with the rotation of motor 41 due to the motor electrical conduction time for 3 seconds. The rising distance of the filter fixing portion 24*b* is 3 mm as explained above.

In consideration of the elongation of the wire, the filter fixing portion is set to be moved up by a slightly longer than the pressing stroke for a latch release from the contained state of the filter fixing portion 24*b*. For this reason, there is provided a clutch (not shown) between the motor 41 and the wire 37 to prevent the filter fixing portion from being lifted up too much.

In step T10, the motor 41 is continued to be rotated in the direction A until the timer t1 counts 3 seconds. In step T11, if it is detected that the timer t1 counts 3 seconds, the motor 41 is once stopped in step T12. At this point, the engagement of the latch body 1 with the engaging claw portion 2 is released.

Sequentially, for determining the move-down distance of the filter fixing portion 24*b*, the setting of the switch 51 for changing the move-down distance is read. In step T13, it is discriminated whether the switch 51 is set to the house or the apartment house.

If the switch 51 is set to the house (Yes), motor conduction time for moving down the filter 14 is set to long time, that is, 35 seconds in step T14.

If the switch 51 is set to the apartment house (No), motor conduction time ts for moving down the filter 14 is set to short time, that is, 20 seconds in step T15.

In any case, the operation goes to step T16, time counting of timer t2 is started, and the motor 41 is rotated in a direction B where the filter fixing portion 24*b* is moved down in step T17.

Since the engagement of the latch body 1 with the engaging claw portion 2 is already released, the filter fixing portion 24*b* is started to be moved down. During the move-down of the filter fixing portion 24*b*, counting time of timer t2 is compared with conduction time ts of the motor 41 in step T18.

Then, when the counting time of timer t2 exceeds conduction time ts of the motor 41 (Yes), the operation goes to step T19 and the motor 41 is stopped.

If the timer t2 is set to be long time, the large move-down distance is formed. In other words, the filter 29 is moved down to the lower position against the indoor unit B, that is, the position where the height from the floor surface is low. On the other hand, if the timer t2 is set to be short time, the short move-down distance is formed. In other word, the filter 29 is moved down to the higher position against the indoor unit B, that is, the position where the height from the floor surface is high.

Next, in step T20, it is discriminated whether or not two limit switches 4 are opened. If there is no obstacle just before the filter fixing portion 24*b*, the filter 29 is normally moved downward, and two limit switches 4 are normally opened.

Therefore, if all limit switches 4 are opened (Yes), the operation goes to the start during the time when the user cleans the filter or replaces with new one. Then, the steps T1 and T4 are repeated until the filter rise instruction for containing the filter fixing portion 24*b* in the indoor unit B is input from the remote controller A.

On the other hand, if one of limit switches 4 is closed for some abnormality (No), the operation goes to step T21 from step T20. Then, data of lift abnormality is set, a lift abnormal display LED 50*a* is turned on, and a lift abnormality signal is sent to the remote controller A. In this state, the air-conditioning is stopped.

As explained above, the lift abnormality display LED 19*a* of the remote controller A is turned on in accordance with the lift abnormality signal. Due to this, when abnormality is detected, both indoor unit B and remote controller A inform abnormality.

As a result, even if the remote controller A and the indoor unit B are provided in the different room, the generation of lift abnormality can be confirmed in either room.

Figure 18:
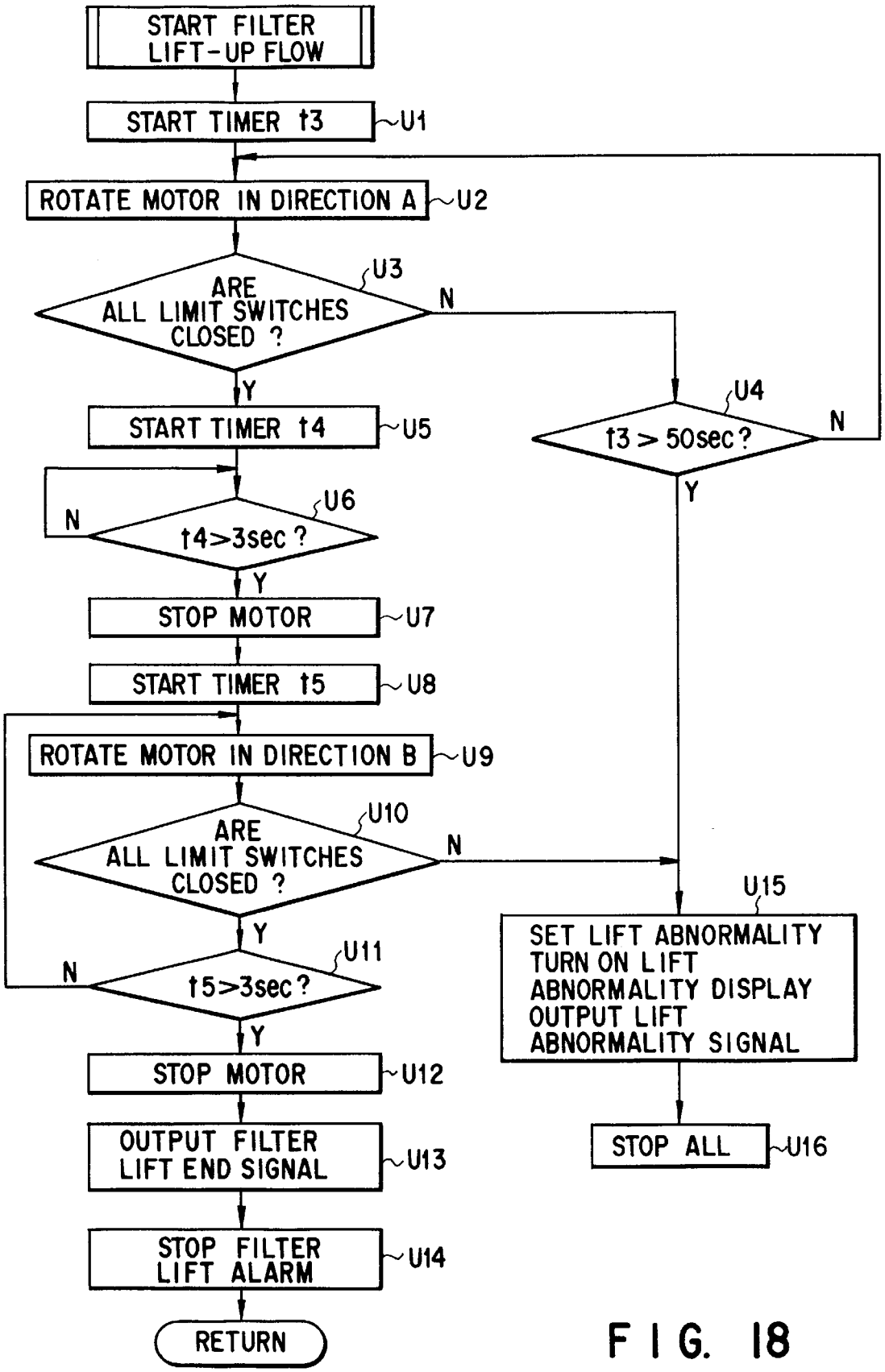
FIG. 18 is a flow chart explaining the closing of the filter fixing portion.

Next, FIG. 18 explains the flow chart showing that the filter fixing portion 24*b* is contained at a predetermined position after cleaning or replacing the filter.

In step U1, a maximum allowable timer t3 for counting maximum motor conduction time, which is enough to move up the filter fixing portion 24*b* to a predetermined position even in the worst case, starts to be operated.

Next, in step U2, the motor 41 is rotated in a direction A where the filter fixing portion 24*b* is moved up.

In step U3, it is discriminated by the open/close state of all limit switches 4 whether or not the filter fixing portion is lifted up to the position where it is contained in the indoor unit B during the rise of the filter fixing portion 24*b*.

If all limit switches 4 are closed (Yes), the increase in which the actuation rod 7 for engaging the engaging claw portion 2 is pushed up is started.

If at least one limit switch 4 is opened (No), the operation goes to step U4, and it is discriminated whether or not the timer t3 exceeds the maximum time limit, that is, 50 seconds.

If either limit switch 4 is not closed (Yes) even after passing 50 seconds since the start of the electrical conduction to the motor 41, there is possibility that a certain obstacle will be sandwiched between the filter fixing portion 24*b* and the indoor unit B.

In other words, the abnormal state is discriminated, the same abnormal process as in steps T21 and T22 of the flow chart at the time when the filter fixing portion 24*b* is moved down is performed in steps U15 and U16.

As the increase for engaging the engaging claw portion 2 with the hook 8 of the latch body 1, in step U5, a timer t4 for an increase, which sets increase time, starts to count time.

Sequentially, in step U6, it is discriminated whether or not counting time of the timer t4 exceeds 3 seconds. If the counting time exceeds 3 seconds (Yes), the electrical conduction to the motor 41 is stopped, and the rise of the filter fixing portion 24*b* in step U7 is stopped.

In step U6, the rotation of the motor 41 set in step U2 is continued. Due to this, the filter fixing portion 24*b* is moved up for only 3 seconds after all limit switches 4 are closed. Thereby, the actuation rod 7 of the latch body 1 reaches the aforementioned upper dead point c.

Sequentially, in step U8, a timer t5 is started. In steps U9, and U11, the motor is rotated in a direction B where the filter fixing portion 24*b* is moved down until the counting time of timber t5 exceeds 3 seconds.

Thereby, the filter fixing portion 24*b* is moved down, and the engaging claw portion 2 is surely engaged with the hook 8. At the same time, the wire 37 is slightly loosened.

As a result, the filter fixing portion 24*b* having the filter 29 is supported by only the latch body 1, and there is no weight to be put on the wire 37, and no load of the wire is not present, so that there is no generation of elongation.

However, in this state, the latch body 1 does not function for some reason, so that there is possibility that the filter fixing portion 24*b* is directly moved down to the predetermined position.

To deal with this problem, if the states of all limit switches 4 are confirmed in step U10 and the limit switches 4 are closed as they are even in moving down the filter fixing portion 24*b*, the descent of the filter fixing portion is executed for 3 seconds. If any limit switch 4 is closed in the middle of the descent, it is discriminated that the engagement of the latch body 1 is not established, and the process for abnormality is executed in step U15 and the following steps.

If the filter fixing portion 24*b* is normally supported by the latch body 1, the motor 41 is stopped in step U12, the filter lift end signal is output in step U13, and the lift alarm sound by the lift alarm buzzer 50*b* is stopped is step U14. Also, the filter lift alarm lamp 19*c* is turned off, and the lift alarm sound by the lift alarm buzzer 19*b* is stopped.

In steps U4 and U10, if the abnormality is discriminated, lift normality data is set in step U15, the lift abnormality display is turned on, and the lift abnormality signal is output to the remote controller, and the operation is completely stopped in step U16.

In the above embodiments, one end portion of the filter fixing portion 24*b* is rotatably supported through the support section 36, and the other end is automatically driven to be lifted as a free end. However, the present invention is not limited to the above embodiment. For example, the present invention can be applied to the structure in which the entire filter fixing portion is lifted in parallel, or the structure in which the user pulls the wire to manually lift the filter fixing portion.

Moreover, in the above embodiments, the wire is used as actuation cord 37. However, the present invention is not limited to the wire. A rope, a braid, and a fishing gut as a fishing line may be used.

Thus, according to the fourth embodiment, the filter replacement can be safely and easily executed even in the air-conditioner of the ceiling attaching type. Also, the ability of the heat exchanger can be maintained in a high state. Moreover, the filter fixing portion is supported by the engaging portion, so that the actuation cords can be loosened, and the load applied on the actuation cords can be reduced to ensure safety. If one actuation cord is cut, the filter can be manually attached and detached.

The above embodiments explained the air-conditioner in which the blow-off dust 26 is connected to the unit body 21. However, the present invention is not limited to the above embodiments. The present invention can be applied to the air-conditioner of the ceiling attaching type in which the inlet port and the blow-off port are opened to the air-conditioning room.

Next, the following will explain a fifth embodiment of the present invention with reference to FIGS. 19 to 21B.

The indoor unit has a housing 61 having a top plate 70 and side plates 71*a* to 71*d* and an opened bottom portion. The housing 61 serves as a unit body. In the housing 61, a centrifugal blower F, which is driven by a motor M, is attached to the central portion of the top plate 70. In the housing 61, a heat exchanger 63 is provided to surround the blower F. The heat exchanger 63 has a quadrilateral shape in its horizontal cross-section.

A drain pan 64, which closes the bottom portion of the housing 61, is also provided. The drain pan 64 has an inlet port 100 on its central portion, and four blow-off passages 102 on its outer peripheral portion. Also, on the upper surface side of the drain pan 64, a concave portion 104 is formed between the inlet port 100 and the blow-off passage 102. The concave portion 104 receives a lower portion 92 of the heat exchanger 63.

Then, the interior of the housing 61 is divided to a side corresponding to the inlet port 100 (space at the upper stream side of the heat exchanger 63) and a side corresponding to the blow-off passage (space at the lower stream side of the heat exchanger 63).

In other words, by the rotation of the centrifugal blower F, indoor air sucks indoor air from the inlet port 100 of the drain pan 64 to be passed through the heat exchanger 63 to generate air-conditioning air. The air-conditioning air is blown into the room through the blow-off passages 102 of the drain pan 64.

A foam heat insulating wall 62 is formed on the inner surface side of the housing 61 as one body. The foam heat insulating wall 62 has side wall portions 81 corresponding to the side plates 71*a* to 71*d* and a rib-shaped upper wall portion 80, which corresponds to the top plate 70 and which extends outwardly.

Then, each lower end surface 88 of the foam heat insulating wall 62 contacts each outer peripheral upper portion 108 of the drain pan 64. Thereby, an upper portion blow-off passage P, which connects to the blow-off passage 102, is formed on the inside of the foam heat insulating wall 62.

Figure 20:
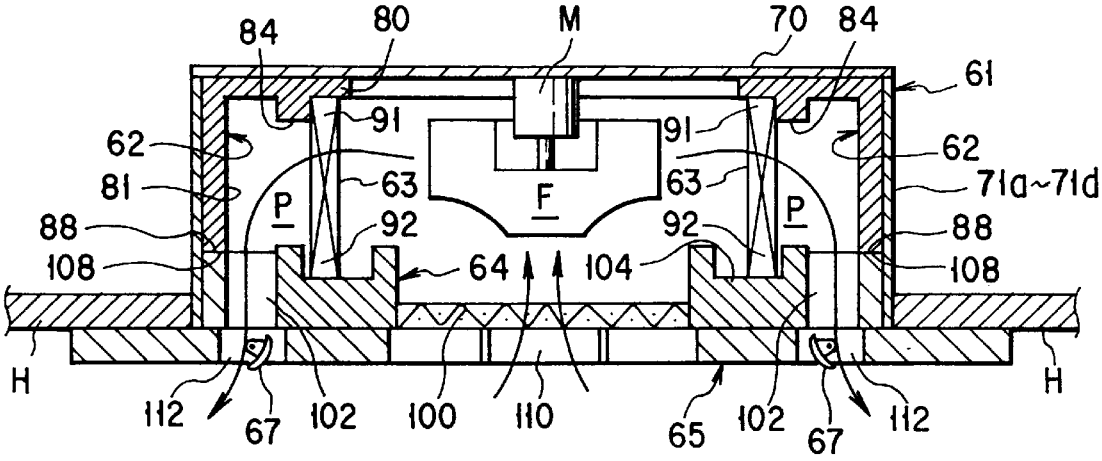
FIG. 20 is a cross-sectional view of the indoor unit.
Figure 21A:
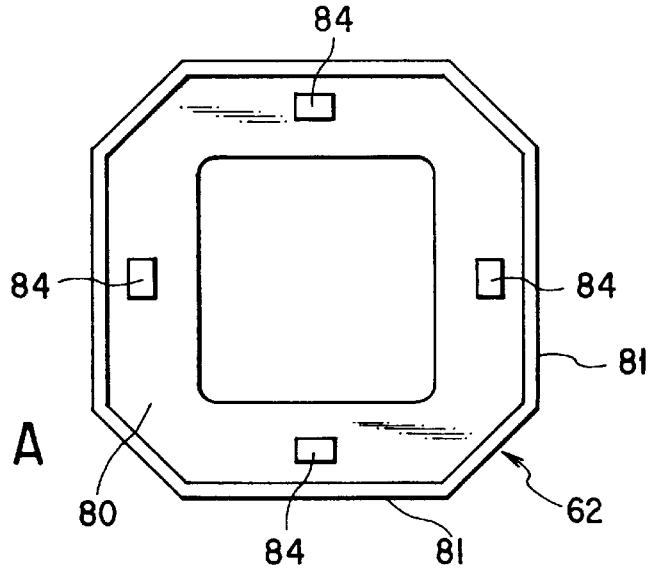
FIG. 21A is a bottom view showing a foam heat insulating material.
Figure 21B:
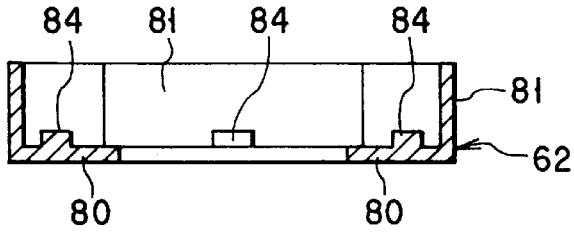
FIG. 21B is a cross-sectional view showing the foam heat insulating material.

The upper wall portion 80 has four projections (engaging portions) 84 each corresponding to each side of the square of the heat exchanger 63. Particularly, as shown in FIG. 20, these projections 84 contact the corresponding downwind side (upper portion blow-off passage P side) of an upper portion 91 of the heat exchanger 63.

The indoor unit has a square decorative panel 65 attached to cover the bottom side of the drain pan and to face to the indoor side. The decorative panel 65 has inlet ports 110 corresponding to the inlet ports 100 of the drain pan and four rectangular blow-off ports 112 corresponding to the four blow-off passages 102 of the drain pan 64.

At the respective blow-off ports 112 of the decorative panel 65, upper and lower wind plates 67 are provided to adjust the upper and lower directions of the blow-off air. The upper and lower wind plates 67 have uniform widths in the longitudinal direction to correspond to the rectangular blow-off ports 112.

A filter (not shown) is provided between the inlet ports 110 and the heat exchanger 63. The filter is attached to a filter fixing portion formed on the decorative panel 65 to be detachable.

Figure 19:
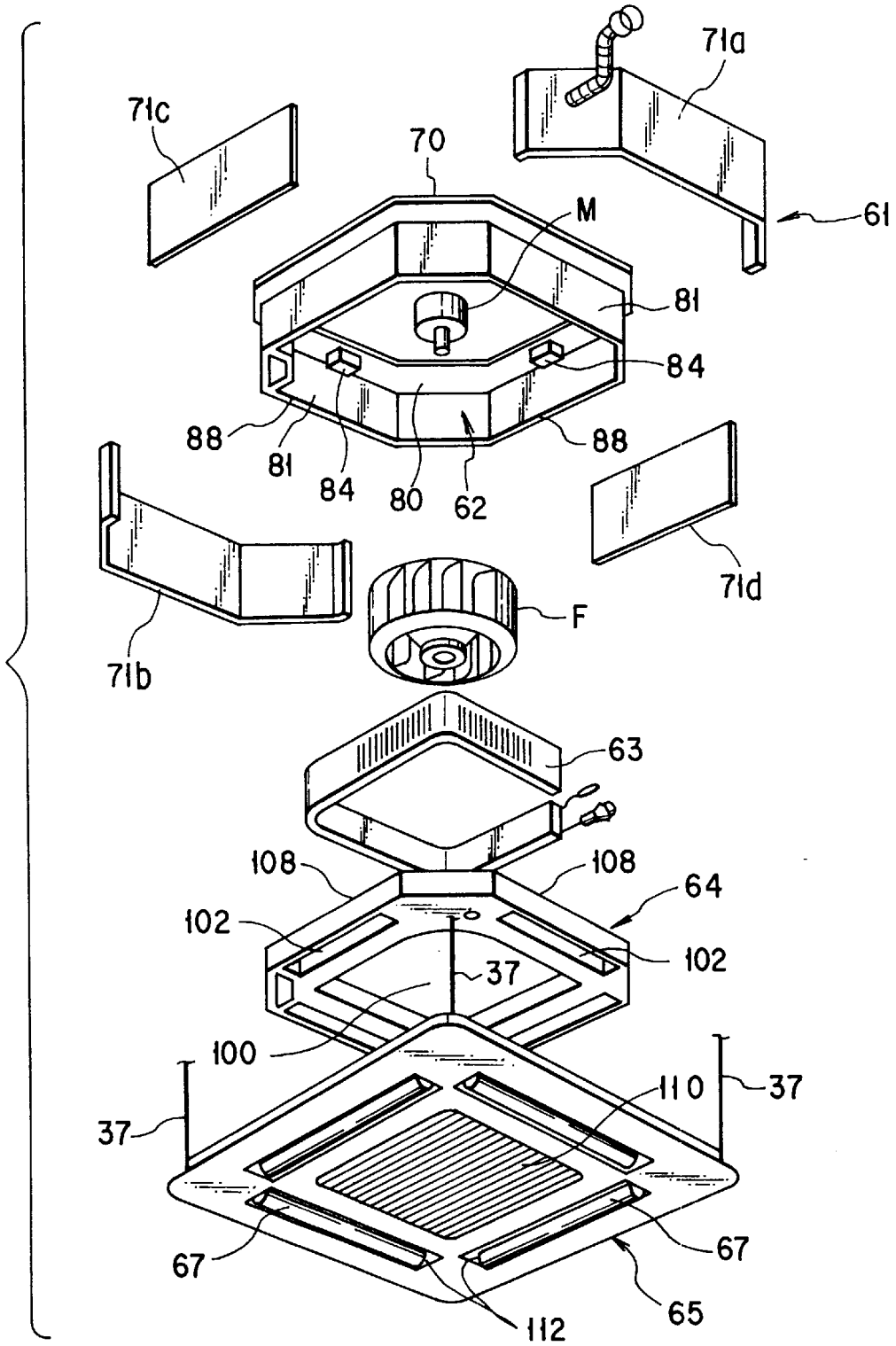
FIG. 19 is a perspective view showing the decomposed indoor unit according to a fifth embodiment of the present invention.

Particularly, as shown in FIG. 19, one end of each wire 37 is connected to portions close to the four corners of the decorative panel 65. The other end of each wire 37 is connected to a lift drive portion having a drive motor (not shown), a rotation drum, etc., provided in the housing 61.

In other words, the open/close drive mechanism to the decorative panel 65 comprises these wires 37 and the lift drive mechanism, so that the panel 65 can be driven to be lifted in a state that the filter is fixed.

When the decorative panel 65 is placed at the predetermined position covering the bottom portion of the drain pan 64, the engaging claw portion attached to the panel 65 is engaged with the latch body attached to the bottom portion of the drain pan 64 (not shown in this figure). The actual lift operation of the decorative panel 65 is the same as previously explained.

In the above-explained indoor unit, four projections 84 are formed on the upper wall portion 80 of the foam heat insulating wall 62 to correspond to the respective sides of the square of the heat exchanger 63. These projections 84 are formed to contact the corresponding downwind sides of the upper portion 91 of the heat exchanger 91. As a result, the heat exchanger 63 can be easily positioned by these projections 84 at a product assembling time. Moreover, the defect of the shape of the heat exchanger such as a curve angle of the square can be easily found out on the basis of the respective projections 84. As a result, the productivity can be improved, and the product having the defective shape of the heat exchanger 63 can be excluded, so that the quality of the product can be stabilized.

The above embodiment explained the case in which the projections 84 contacting the downwind sides of the upper portion 91 of the heat exchanger are formed on the upper wall portion 80 of the foam heat insulating wall 62. In place of these projection 84 or in addition to the projections 84, projections contacting the upwind sides (blower F side) of the upper portion 91 may be formed on the upper wall portion 80.

Figure 22:
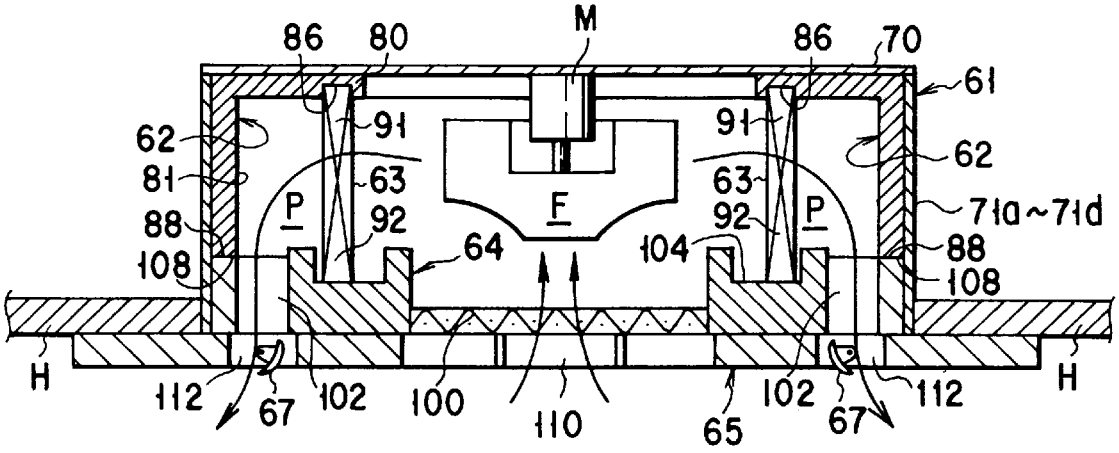
FIG. 22 is a cross-sectional view of the indoor unit according to a sixth embodiment of the present invention.
Figure 23A:
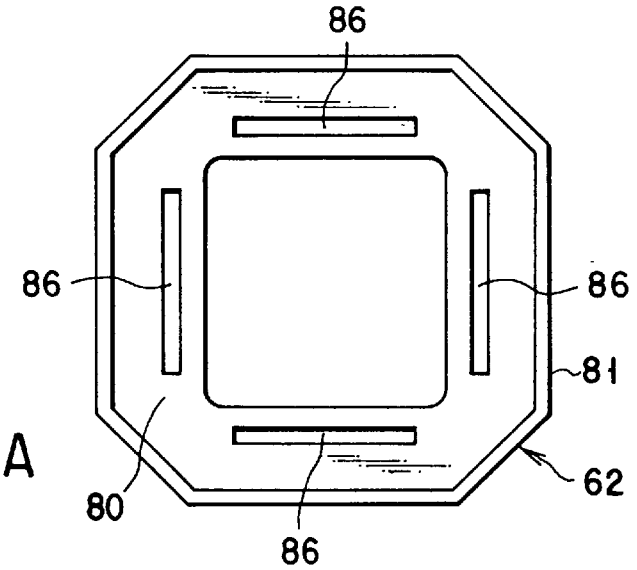
FIG. 23A is a bottom view showing a foam heat insulating material.
Figure 23B:
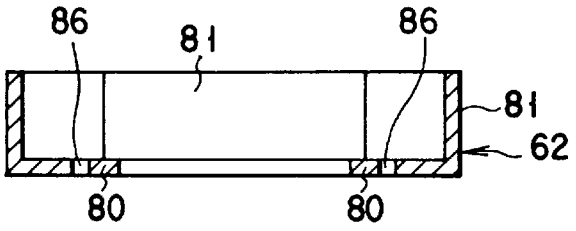
FIG. 23B is a cross-sectional view showing the foam heat insulating material.

Next, the following will explain a sixth embodiment of the present invention with reference to FIGS. 22, 23A and 23B.

In this embodiment, in place of the projections 84 of the foam heat insulating wall 62 of the fifth embodiment, grooves 86 where the upper portion 91 of the heat exchanger 63 is inserted are formed on the upper wall portion 80 of the foam heat insulating wall 62. The other structure is the same as the fifth embodiment of FIGS. 19 and 20.

In other words, the heat exchanger 63 can be easily positioned by the grooves 86 at the product assembling time. Moreover, the defect of the shape of the heat exchanger such as a curve angle of the square can be easily found out on the basis of the grooves 86. As a result, similar to the fifth embodiment, the productivity can be improved, and the product having the defective shape of the heat exchanger 63 can be excluded, so that the quality of the product can be stabilized.

Figure 24:
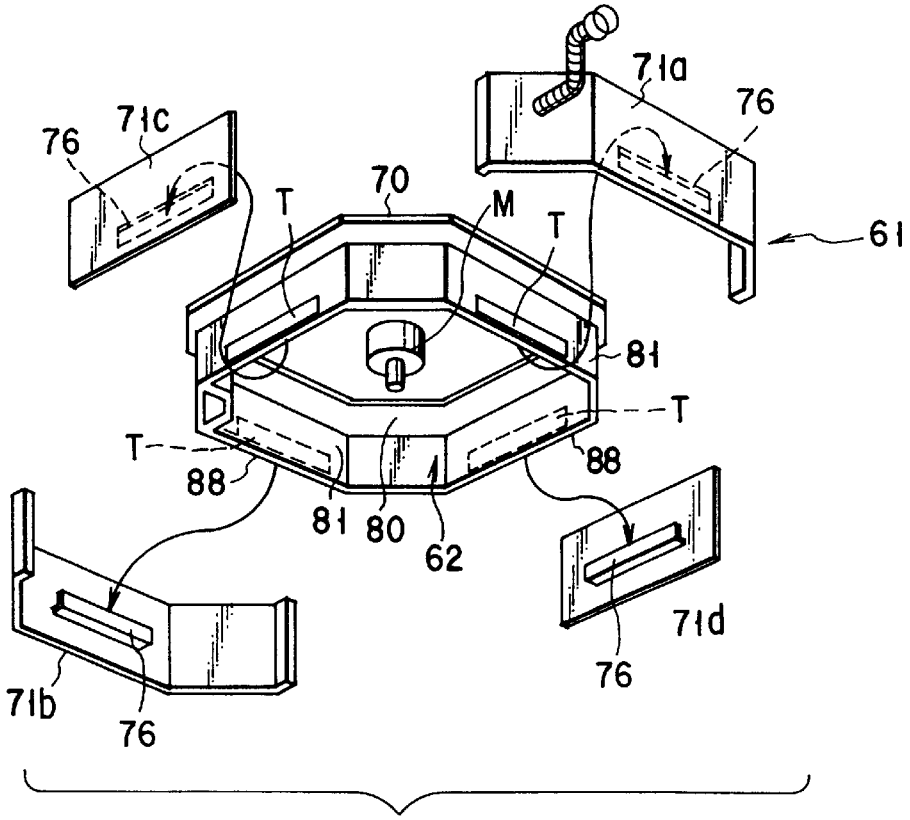
FIG. 24 is a perspective view showing a main part of the indoor unit, which is decomposed, according to a seventh embodiment of the present invention.
Figure 25:
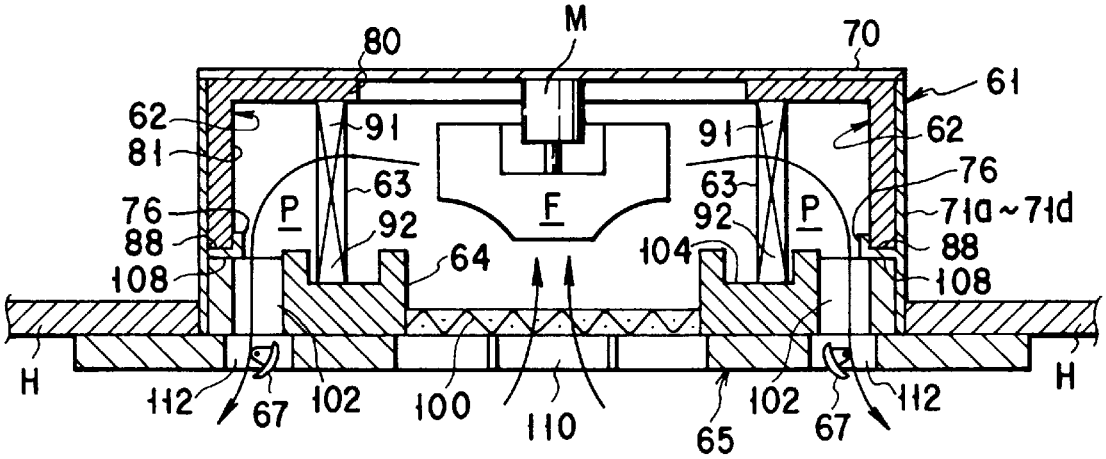
FIG. 25 is a cross-sectional view of the indoor unit.

Next, the following will explain a seventh embodiment of the present invention with reference to FIGS. 24 and 25.

This embodiment is different from the fifth embodiment the point that claw portions 76 for engaging the lower portion of the side wall portion 81 of the foam heat insulating wall 62 are formed on the insides of the respective side plates 71*a* to 71*d* of the housing 61. The other structure is substantially the same as the fifth embodiment. Each claw portion 76 of the housing 61 has an L-shaped cross-section to which the lower end portion of the side wall portion 81 of the corresponding foam heat insulating wall 62 is inserted.

Thus, the portions 76 for engaging the lower portion of the side wall portion 81 of the foam heat insulating wall 62 are formed on the insides of the respective side plates 71*a* to 71*d* of the housing 61. By these claw portions, the foam heat insulating wall 81 of the foam heat insulating wall 62 for forming the upper portion blow-off passage P can be prevented from being deformed. Therefore, a decrease in an amount of blow-off air due to the deformation of the side wall portion 81 of the foam heat insulating wall 62 and an increase in blow-off noise can be prevented.

In this embodiment, as shown by only FIG. 24, even if the side plates 71*a* to 76d and the side wall 81 of the corresponding foam heat insulating wall 62 are combined with each other with an adhesive member T such as pressure sensitive adhesive double coated tape material T, the deformation of the side wall portion 21 of the foam heat insulating wall 2 can be prevented.

Figure 26:
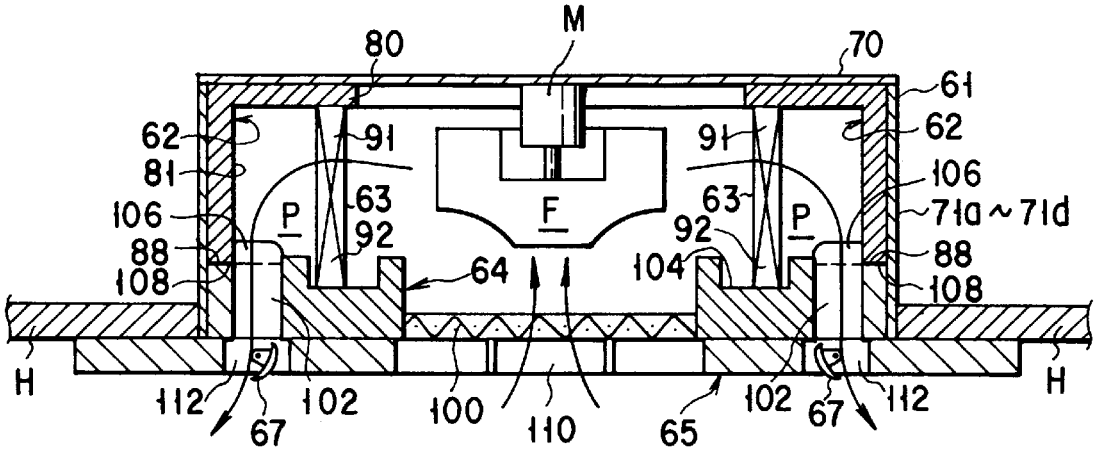
FIG. 26 is a cross-sectional view of the indoor unit according to an eighth embodiment of the present invention.
Figure 27A:
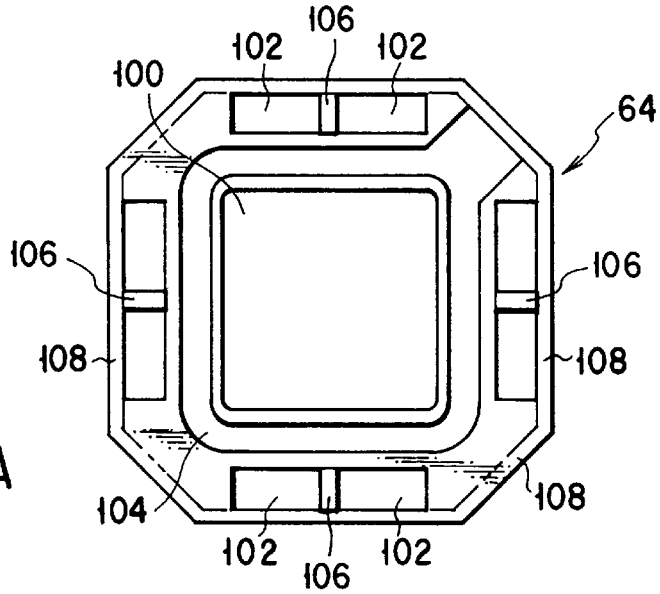
FIG. 27A is a plain view showing a drain dish.
Figure 27B:
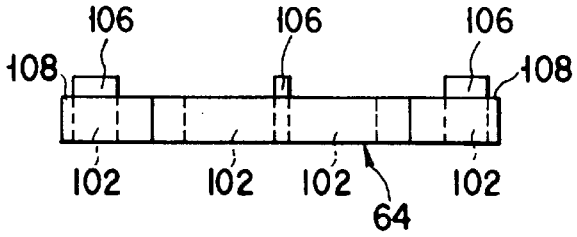
FIG. 27B is a side view showing the drain dish.
Figure 28:
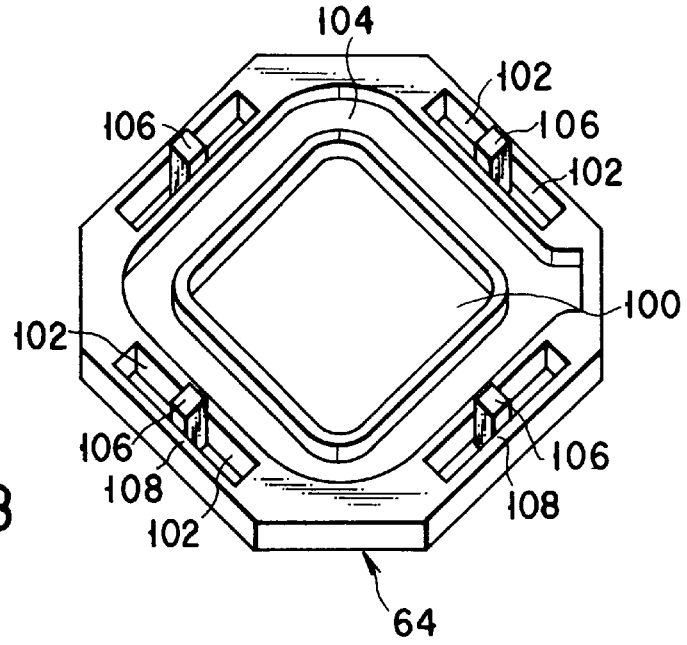
FIG. 28 is a perspective view showing the drain dish.

Next, the following will explain an eighth embodiment of the present invention with reference to FIGS. 26 to 28.

This embodiment is different from the fifth embodiment in the point that four engaging projections 106, which contact the inner surface side of the lower portion of the side wall portion 81 of the foam heat insulating wall 62, are formed in the drain pan 64. The other structure is substantially the same as the fifth embodiment.

The engaging portions 106 are formed to be projected upward from the central portion of each blow-off passage 102 of the drain pan 64, and to partition the respective blow-off passages 102 to two portions.

This embodiment is not limited to the case in which one engaging projection 106 is formed at the central portion of each blow-off passage 102 of the drain pan 64. A plurality of engaging portions 106 may be formed at the central portion of each blow-off passage 102.

Thus, the four engaging projections 106, which contact the inner surface side of the lower portion of the side wall portion 81 of the foam heat insulating wall 62, are formed in the drain pan 64. By these engaging projections 106, the foam heat insulating wall 81 of the foam heat insulating wall 62 for forming the upper portion blow-off passage P can be prevented from being deformed. Therefore, similar to the seventh embodiment, a decrease in an amount of blow-off air due to the deformation of the side wall portion 81 of the foam heat insulating wall 62 and an increase in blow-off noise can be prevented.

Figure 29:
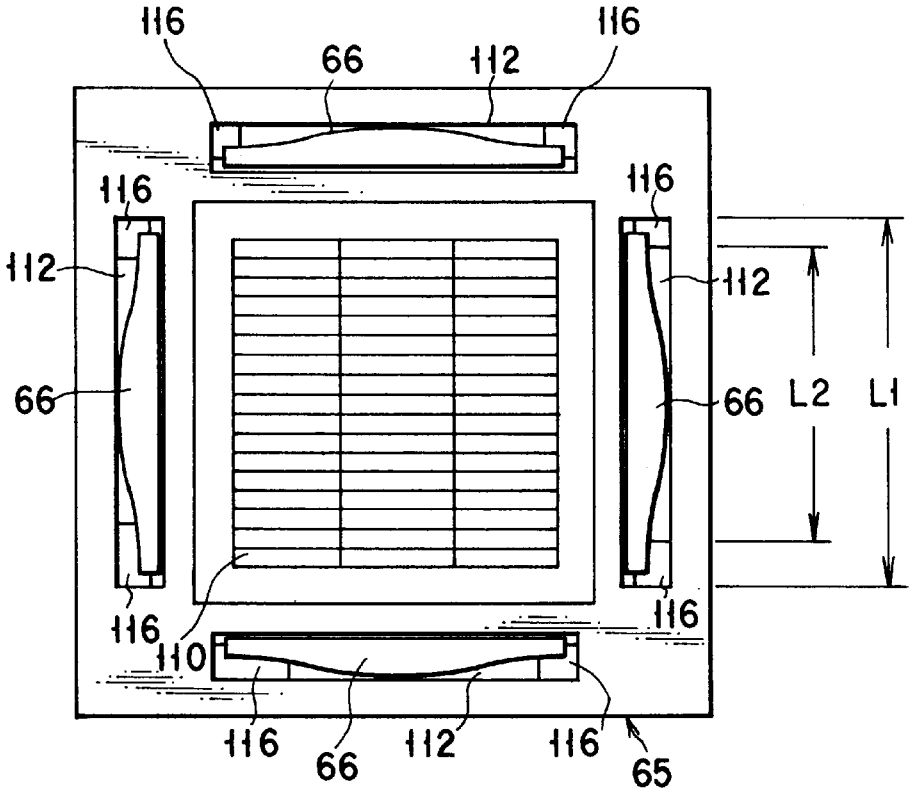
FIG. 29 is a bottom view of the indoor unit according to a ninth embodiment of the present invention.
Figure 30:
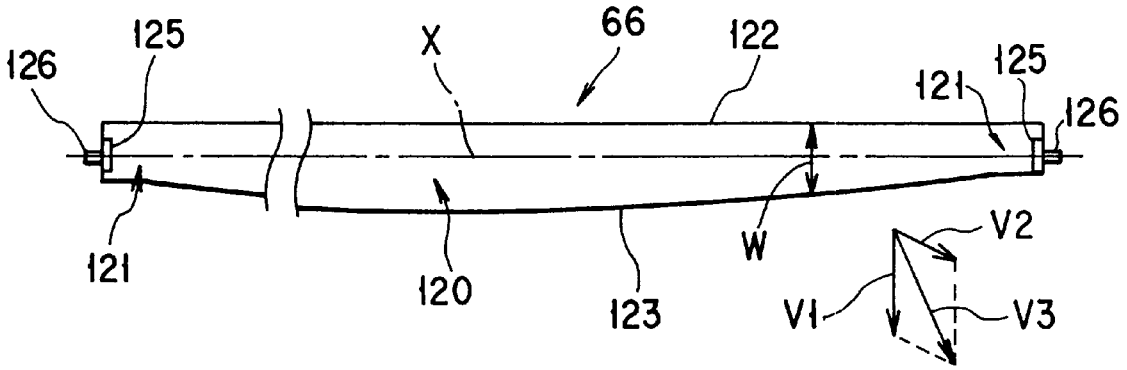
FIG. 30 is a plane view showing upper and lower wind-direction plates.
Figure 31:
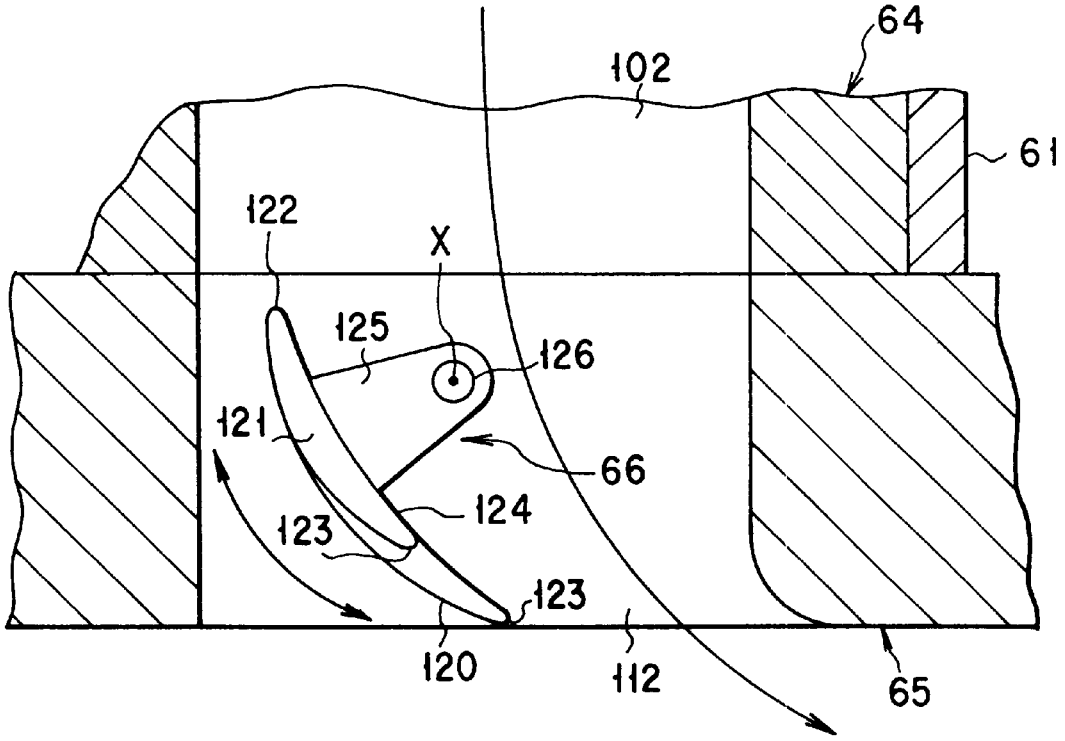
FIG. 31 is a cross-sectional view showing an enlarged a blow-off portion of a ceiling panel seeing from one end portion of the upper and lower wind-direction plates.

Next, the following will explain a ninth embodiment of the present invention with reference to FIGS. 29 to 31.

This embodiment is different from the fifth embodiment in the point that upper and lower wind plates 66 having a different shape are formed on the respective blow-off ports 112 of the ceiling panel 65 in place of the upper and lower wind plates 67 of the fifth embodiment.

As shown in FIG. 29, a length L1 of each blow-off port of the ceiling panel 65 where the upper and lower wind plates 66 are formed is larger than a length L2 of the blow-off passage 102 of the corresponding drain pan 64 in view of the design (FIGS. 19 and 20). To correspond to this condition, the inner sides of both end portions of each blow-off port 112 are closed by a wind shielding material 116.

Moreover, as shown in FIG. 30, the upper and lower wind plates 66 are formed such that a blow-off air upper stream side 122 (hereinafter simply called "upper stream side 122") is linearly shaped. Also, the wind plates 66 has a curve in which its width w gradually becomes narrower as an air lower stream side 123 (hereinafter simply called "lower stream side 123") is directed from a central portion 120 (hereinafter simply called "central portion 120") of its longitudinal direction to both end portions 121 (hereinafter simply called "both end portions 121").

As shown in FIG. 31, the upper and lower wind plates 66 are provided in the blow-off port 112 of the ceiling panel 65 to be rotatable around a rotation axis X (FIG. 30). Moreover, a tongue portion 125 is formed on each of both end portions 121 of the upper and lower wind plates 66 to be projected to an upper surface 124 of the upper and lower wind plates 66.

A support shaft 126, which corresponds to the rotation axis X, is provided on the top end portion of each tongue portion 125. As is obvious from FIG. 31, the upper and lower wind plates 66 are curved to the upper surface side 124 in its horizontal cross-section such that the flow of the blow-off air is effectively deflected.

Thus, in the upper and lower wind plates 66, the upper stream side 122 is linearly shaped. Also, the width w gradually becomes narrower as the lower stream side 123 is directed from the central portion 120 of its longitudinal direction to both end portions 121 (hereinafter simply called "both end portion 121"). As compared with the conventional upper and lower wind plates having a uniform width, the both end portions 121 are placed at the position away from the indoor side (lower side of FIG. 31).

Also, at the both end portions 121 of the upper and lower wind plates 66, the width w is narrower than the case at the central portion 120. As a result, air resistance becomes smaller than the case of the central portion 120. Thereby, as shown in FIG. 30, there is generated blow-off air flow (flow velocity v2), which is deflected to the both end portions 121 in addition to the conventional blow-off air flow (flow velocity v1). Due to this, as compared with the conventional upper and lower wind plates having a uniform width, substantial flow velocity (v3) of the blow-off air at the both end portions is increased.

As a result, at the both end portions 121 of the upper and lower wind plates 66, it is possible to prevent condensation due to the winding of indoor air at a cooling operation time. Moreover, by the generation of the blow-off air flow (flow velocity v2), which is deflected to the both end portions 121, the blow-off width of the blow-off air in the longitudinal direction of the upper and lower wind plates 66 can be increased.

The above explained the case in which the lower stream side 123 is curved. However, if the width w of the upper and lower wind plates 66 gradually becomes narrower as the lower stream side 123 is directed from the central portion 120 of its longitudinal direction to both end portions 121, the lower stream side 123 may be shaped by combining a plurality of straight lines or the straight line with the curve.

Figure 32A:
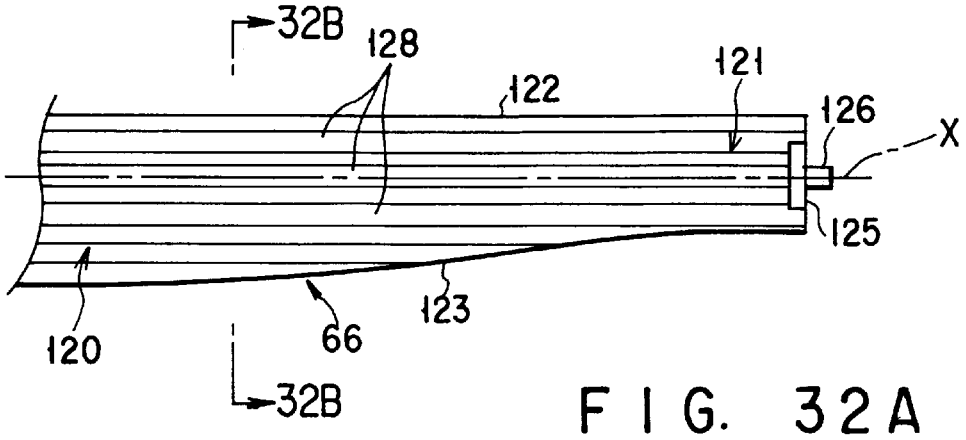
FIG. 32A is a plane view showing upper and lower wind-direction plates according to a tenth embodiment.
Figure 32B:
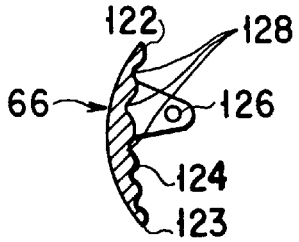
FIG. 32B is a cross-sectional view taken along a line 32B—32B of FIG. 32A.

Next, the following will explain a tenth embodiment of the present invention with reference to FIGS. 32A and 32B.

This embodiment is different from the fifth embodiment in the point that a plurality of conductive wind grooves 128, which extend in the longitudinal direction, is formed on the upper surface 124 of the upper and lower wind plates 66 of the ninth embodiment. The other structure is the same as the fifth embodiment.

Figure 33A:
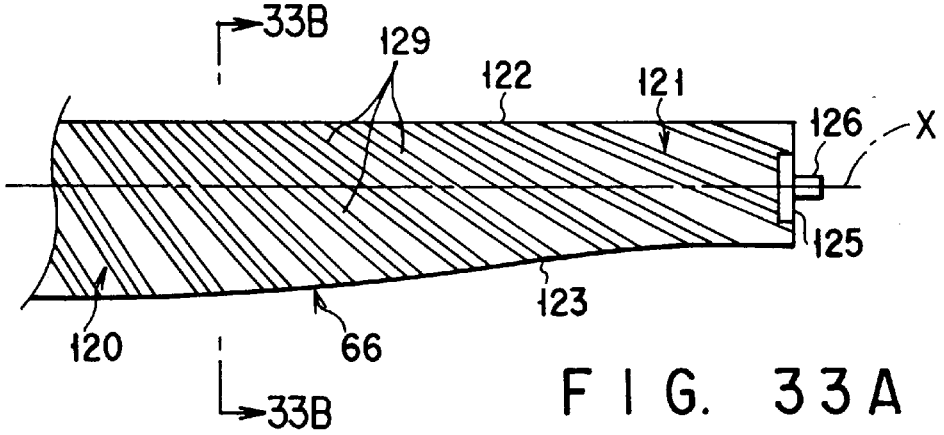
FIG. 33A is a modification of the upper and lower wind-direction plates of FIGS. 32A and 32B, and is a plane view showing upper and lower wind-direction plates.
Figure 33B:
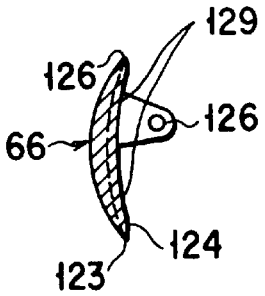
FIG. 33B is a cross-sectional view taken along a line 33B—33B of FIG. 33A.

Moreover, in a modification of the embodiment shown in FIGS. 33A and 33B, in place of the plurality of conductive wind grooves 128 of FIGS. 32A and 32B, there is formed a plurality of conductive wind grooves 129, which radially extend to both ends 121 at the lower stream side 123 from the central portion 120 at the upper stream side 122.

As a result, the blow-off air flow along the upper surface 124 easily flows to both end portion 121. The blow-off air flow, which is deflected to the both end portions 121, can be further improved, so that the effect of the ninth embodiment can be further reinforced.

Additional advantages and modifications will readily occur to those skilled in the art. Therefore, the invention in its broader aspects is not limited to the specific details and representative embodiments shown and described herein. Accordingly, various modifications may be made without departing from the spirit of scope of the general inventive concept as defined by the appended claims and their equivalents.

We claim:

1. An indoor unit of an air-conditioner, comprising:

a unit body constructed and arranged so that it can be recessed in a ceiling, having a lower surface portion exposed inside a room, comprising:

at least one indoor heat exchanger arranged in said unit body;

a blower fixed to said unit body; and a filter;

wherein the lower surface portion is a decorative panel having a frame portion, having an inlet port for guiding air in a room to said indoor heat exchanger, and having a filter fixing portion, structured as a part of said decorative panel, wherein said filter is detachably attached to the filter fixing portion;

a support portion provided on one side end of the filter fixing portion for supporting the filter fixing portion to be freely rotatable with respect to the frame of said decorative panel; and an open/close driving mechanism positioned in a spatial portion of a central panel portion of said decorative panel for driving the filter fixing portion to be freely opened and closed against the frame of said decorative panel in a state that said support portion is used as a fulcrum, comprising:

an actuation cord having one end portion connected to a free end of the filter fixing, portion of said decorative panel;

a belt member connected to another end of said actuation cord;

a pair of pulleys for engaging with said belt member to be endlessly and freely run; and a drive source coupled to a support shaft of one of said pair of pulleys, for reciprocating said belt member through said one of said pair of pulleys to open/close the filter fixing portion of said decorative panel to said unit body.

2. An indoor unit-of an air-conditioner, comprising:

a unit body constructed and arranged so that it can be recessed in a ceiling, having a lower surface portion exposed inside a room, comprising:

at least one indoor heat exchanger arranged in said unit body;

a blower fixed to said unit body; and a filter;

wherein the lower surface portion is a decorative panel having a frame portion, and having an inlet port for guiding air in a room to said indoor heat exchanger, and having a filter fixing portion, structured as a part of said decorative panel, said filter being detachably attached to the filter fixing portion;

a support portion provided on one side end of the filter fixing portion for supporting the filter fixing portion to be freely rotatable with respect to the frame of said decorative panel; and an open/close driving mechanism positioned in a spatial portion of a central panel portion of said decorative panel for driving the filter fixing portion to be freely opened and closed against the frame of said decorative panel in a state that said support portion is used as a fulcrum, comprising:

an actuation cord having one end connected to a free end of the filter fixing portion, having another end fixed to a fixing portion, and having a middle portion;

a belt member having a pulley for an engagement with the actuation cord on its middle portion;

a pair of pulleys for engaging with said belt member to be endlessly and freely run; and a drive source, coupled to a support shaft of one of said pair of pulleys, for reciprocating said belt member and the pulley for the engagement with the actuation cord through the pulley and to move the actuation cord through the pulley and to move the actuation cord back and forth, thereby opening/closing the filter fixing portion of said decorative panel to the unit body.

3. An indoor unit of an air-conditioner, comprising:

a unit body constructed and arranged so that it can be recessed in a ceiling, having a lower surface portion exposed inside a room, comprising:

at least one indoor heat exchanger arranged in said unit body;

a blower fixed to said unit body; and a filter;

wherein the lower surface portion is a decorative panel having a frame portion, and having an inlet port for guiding air in a room to said indoor heat exchanger, and having a filter fixing portion, structured as a part of said decorative panel, said filter being detachably attached to the filter fixing portion;

a support portion provided on one side end of the filter fixing portion for supporting the filter fixing portion to be freely rotatable with respect to the frame of said decorative panel; and an open/close driving mechanism positioned in a spatial portion of a central panel portion of said decorative panel for driving the filter fixing portion to be freely opened and closed against the frame of said decorative panel in a state that said support portion is used as a fulcrum, comprising:

a belt member having a pulley;

an idle pulley provided at a position close to said belt member;

an actuation cord bent to form an intermediate portion having one end connected to one free end of the filter fixing portion and a second end connected to a second free end of the filter fixing portion, and having a middle portion, wherein said pulley of said belt member engages with said actuation cord on the middle portion for the engagement of the actuation cord to be doubled, and wherein the bent portion of said actuation cord engages with said idle pulley;

a pair of pulleys for engaging with said belt member to be endlessly and freely run; and a drive source, coupled to a support shaft of one of said pair of pulleys, for reciprocating said belt member and the pulley for the engagement with the actuation cord through the pulley and to move the actuation cord back and forth, thereby opening/closing the filter fixing portion of said decorative panel to the unit body.

4. The indoor unit according to claims 1, 2, or 3, wherein said open/close driving mechanism uses a DC motor, which is positively and reversely rotatable, as the drive source, and a bevel gear is provided between said drive source and said pulley.

5. The indoor unit according to claims 1, 2, or 3, wherein magnets are attached to free end sides of said filter fixing portion, and magnetization members, which are magnetically absorbed by said magnet, are attached to the portion opposite to said unit body.

6. The indoor unit according to claims 1, 2, or 3, wherein said open/close mechanism comprises means for continuing an operation for a predetermined period of time even after operation time necessary for closing said filter fixing portion is ended, and for stopping the operation after the continuous operation for the predetermined period of time.

7. The indoor unit according to claims 1, 2, or 3, wherein said unit body has a blow-off port at a side surface portion positioned at the rear of the ceiling, and a duct is connected to said blow-off port to guide heat exchange air to a predetermined air-conditioning portion.

8. The indoor unit according to claim 7, wherein a plurality of inlet ports to be separated from each other and to be formed in parallel; a plurality of blow-off ports is provided on a side surface portion opposite to a unit body; a plurality of draft passages communicating the inlet ports and the blow-off ports with other; and said blower is provided on each of said draft passages.

9. The indoor unit according to claim 7, wherein said blower is a centrifugal blower comprising a fan motor and a scirocco fan attached to a rotation shaft of the fan motor.

10. An indoor unit of an air-conditioner comprising:

a unit body, constructed and arranged so that it can be recessed in a ceiling, having a lower surface portion exposed inside a room, comprising:

at least one indoor heat exchanger arranged in said unit body;

a blower fixed to said unit body; and a filter;

wherein an inlet port is provided on the lower surface portion of said unit body for guiding air in a room to said at least one indoor heat exchanger, and a filter fixing portion is provided at a position opposite to said inlet port, said filter being detachably attached to the filter fixing portion;

a drive mechanism for lifting the filter fixing portion up and down, wherein said drive mechanism comprises a plurality of actuation cords, and is placed at a position close to a hanging portion of each said plurality of actuation cords;

an engaging portion for engaging the filter fixing portion to said unit body and to detach from containing the filter fixing portion to said unit body by said drive mechanism, wherein said engaging portion engages with the filter fixing portion by applying a pressing force, and disengages with the filter fixing portion by applying a pressing force again, and wherein a number of said engaging portions is provided to be the same as a number of said plurality of actuation cords; and a detection switch, provided at a position adjacent to said engaging portions, for detecting when said engaging portions are set in a containing state to engage with the filter fixing portion.

11. The indoor unit according to claim 10, further comprising:

a motor, connected to said plurality of actuation cords, for positively rotating to pull up said plurality of actuation cords, thereby lifting up the filter fixing portion, and for reversely rotating to pull down the actuation cords thereby lifting down the filter fixing portion;

a decorative panel provided as the lower surface portion of said unit body; and a controlling means for controlling said motor to be positively rotated to pull up said plurality of actuation cords from the time when the filter fixing portion is moved down until said detection switch detects that said engaging portions are set in a contacting state to engage with the filter fixing portion, thereby lifting up the filter fixing portion, and for controlling said motor to be reversely rotated to pull down said plurality of actuation cords after the detection of said detection switch, thereby lifting down the filter fixing portion.

12. The indoor unit according to claim 11, wherein said controlling means controls said motor to be once positively rotated from a state that said engaging portions engage with said filter fixing portion to pull up the actuation cords, thereby lifting up said filter fixing portion, and said controlling means controls said motor to be reversely rotated to pull down the actuation cords after disengaging with said filter fixing portion by adding pressing force, thereby lifting down said filter fixing portion.

13. The indoor unit according to claim 10, further comprising a movement alarm device, provided in said unit body, for giving an alarm when said filter fixing portion is lifted up and down.

14. The indoor unit according to claim 10, wherein said unit body has a top plate, and a side plate, said blower is positioned at substantially a central portion of the top plate, said indoor heat exchanger is provided to surround said blower and to have a drain pan on its bottom portion, said drain pan has an opening portion communicating with said inlet port at its central portion and a blow-off passage at its outer peripheral portion, an interior of said unit body is divided into a side corresponding to the opening potion of said drain pan and a side corresponding to the blow-off passage of said drain pan, said unit main body has a foam heat insulating wall on its inside, and said foam heat insulating material has an engaging portion for positioning an upper portion of said indoor heat exchanger at a predetermined position.

15. An indoor unit of an air-conditioner comprising:

a unit body, provided on a rear of a ceiling, having an lower surface portion exposed indoor and an indoor heat exchanger and a blower in its exterior;

a decorative panel, structured as the lower surface portion for said unit body, having an inlet port for guiding air in a room to said indoor heat exchanger;

a filter fixing portion, structured as a part of said decorative panel, having a filter attached to a position opposite to said inlet port to be detachable;

actuation cords for hanging said filter fixing portion, and lifting up and down said filter fixing portion to open/close said decorative panel;

engaging portions for detachably engaging with said filter fixing portion by adding pressing force when said filter fixing portion closes said decorative panel, and disengages with said filter fixing portion by adding pressing force again;

a motor positively rotating to pull up the actuation cords, thereby lifting up said filter fixing portion, and for reversely rotating to pull down the actuation cords thereby lifting down said filter fixing portion;

a detection switch, provided at a position adjacent to said engaging portions, for detecting that said engaging portions are set in a state to engage with said filter fixing portion; and controlling means for controlling said motor to be once positively rotated from a state that said engaging portions engage with said filter fixing portion to pull up the actuation cords in accordance with an operation of a filter lifting switch, thereafter controlling said motor to be reversely rotated to pull down the filter fixing portion to be stopped, and said controlling means for controlling said motor to be, positively rotated to pull up said filter fixing portion from the time when said filter fixing portion opens said decorative panel until said detection switch detects that said engaging portions are set in a state to engage with said filter fixing portion in accordance with the operation of the filter lifting switch, after detecting, said controlling means for further pulling up said filter fixing portion, and thereafter reversely rotating said motor to loosen said actuation cords to pull down the filter fixing portion to be stopped.

16. The indoor unit according to claim 15, further comprising a movement alarm device, provided in said unit body, for giving an alarm when said filter fixing portion is lifted up and down.

17. The indoor unit according to claim 15, wherein said engaging portions has a pressing stroke with a predetermined distance, and said detection switch is a limit switch for checking that said engaging portions are set in a state to engage with said filter fixing portion over an entire range of the pressing stroke from the pressing start of said engaging portions till the pressing end.

18. The indoor unit according to claim 17, wherein a distance where said filter fixing portion is once pulled up by said motor is set to be more than the pressing stroke of said engaging portions.

19. The indoor unit according to claim 18, wherein a distance where said filter fixing portion is further pulled up after said detection switch detects that said engaging portions are set in a state to engage with said filter fixing portion is set to be more than the pressing stroke of said engaging portions.

20. The indoor unit according to claim 15, further comprising an abnormality alarming device for alarming abnormality when it is undetected by said detection switch that said engaging portions are set in a state to engage with said filter fixing portion even if the motor positively rotates to pull up the filter fixing portion for a predetermined period of time from the filter fixing portion opening state.

21. The indoor unit according to claim 15, further comprising pull-down distance setting means for controlling the distance where said filter fixing portion is pulled down by operation time of the motor, and for changing the operation time of said motor in pulling down said filter fixing portion.

* * * * *